United States Patent [19]

Pollock

[11] Patent Number: 5,038,534

[45] Date of Patent: Aug. 13, 1991

[54] UNITARY PANEL MODULE AND CONNECTOR

[76] Inventor: Gordon J. Pollock, 3719 Addington Ct., Fairview Park, Ohio 44126

[21] Appl. No.: 451,753

[22] Filed: Dec. 18, 1989

[51] Int. Cl.[5] ..... E04B 2/78; E04B 2/82

[52] U.S. Cl. ..... 52/126.4; 52/241

[58] Field of Search ..... 52/241, 243.1, 126.4, 52/126.3, 582, 584

[56] References Cited

U.S. PATENT DOCUMENTS

| | | | |
|---|---|---|---|
| 2,430,961 | 11/1947 | Sprunger | 52/584 |
| 2,999,568 | 9/1961 | Ludwig | 52/238.1 |
| 3,072,227 | 1/1963 | Baker | 52/241 |
| 3,408,781 | 11/1968 | Pollock . | |
| 3,517,467 | 6/1970 | Propst | 52/584 |
| 3,566,559 | 3/1971 | Dickson | 52/126.4 |
| 3,694,975 | 10/1972 | Pollock . | |
| 4,037,380 | 7/1977 | Pollock . | |
| 4,833,848 | 5/1989 | Guerin | 52/238.1 |

FOREIGN PATENT DOCUMENTS

| | | | |
|---|---|---|---|
| Ad.82442 | 12/1963 | France | 52/241 |

*Primary Examiner*—John E. Murtagh

*Attorney, Agent, or Firm*—Tarolli, Sundheim & Covell

[57] ABSTRACT

Improved unitary panel modules are used in constructing a partition. The panel modules are assembled and then shipped to a location where they are to be installed. Each unitary panel module includes an adjustable base assembly and a resiliently compressible head assembly. When a partition is being constructed, a second unitary panel module is connected with the first panel module by an improved connector assembly. The connector assembly includes a connector member having hooks which engage a vertical support member on one of the panel modules and slots which are engaged by hooks on another panel module.

17 Claims, 13 Drawing Sheets

UNITARY PANEL MODULE AND CONNECTOR

BACKGROUND OF THE INVENTION

The present invention relates to a new and improved panel module which is readily installed in a building and to the manner in which the panel module is connected with adjacent panel modules.

Partitions are commonly utilized to form semi-permanent or movable space enclosures within a larger fixed area, space or room of a building. These areas are generally provided with a suspended acoustical ceiling. It is essential for the movable partition to extend full height from the floor to the suspended ceiling to provide acoustical privacy between offices Movable partitions have been factory manufactured, pre-dimensioned modular panels which are generally made of a metal which can be formed, such as sheet steel. The edges of the panels can be bent and formed to provide suitable arrangements for fixedly securing adjacent panels to each other and to base supports and to head pieces. Examples of movable partitions constructed in this manner are disclosed in U.S. Pat. Nos. 3,408,781; 3,694,975; and 4,037,380.

Although these movable partitions may be deemed to be totally movable and salvageable, they require considerable cutting and fitting of base and head pieces for each specific room arrangement. The members are attached to the building floor or the suspended ceiling. When the partition is dismantled for rearrangement, it is necessary to disconnect the members. Since the length of the walls will usually be changed, it is usually necessary to cut and fit the members to suit the new arrangement of partition sections. This requires purchasing and fitting of additional members because of the loss due to the cutting and waste.

Known movable partitions commonly require linkage plates or clips to join the panel edges. A snap-on pilaster cap is used to finish the connection. These linkage plates and pilaster caps must be a different configuration for each straight, corner or three-way connection. This may also require purchasing additional members to complete the rearrangement. It is extremely important for the partition members which join the suspended ceiling and floor to provide sufficient adjustment to compensate for the irregularities of the floor and ceiling as well as the variations in height between the floor and ceiling.

In the past, movable partitions have been custom fitted, to a greater or lesser extent, to the dimensions of building and space in which they are to be installed. This has required considerable time on the part of installers to attach floor and ceiling tracks before setting the panels for the partition in place. In addition, considerable installation time has been required to fit the various panels of a partition in place. Since installation takes place at many different locations and is performed by installers having different degrees of skill and motivation, installing of a movable partition has frequently been time-consuming and relatively expensive.

SUMMARY OF THE INVENTION

The present invention provides a unitary panel module which is used in constructing a partition. The panel module is assembled at a factory or other location and shipped to the building where it is to be installed. To install the pre-assembled panel module, a resiliently compressible upper end portion or head assembly of the panel module is positioned in engagement with a ceiling structure at a desired location. An upward force is applied against the lower portion of the panel module to resiliently compress the head assembly against the ceiling structure and to lift the lower end portion of the panel module from the floor. The base of the panel module can then be positioned in a desired location relative to the floor without dragging the panel module across the floor.

Each panel module is a unitary structure which includes a pair of main panel members which are connected with a main frame. An adjustable base assembly is disposed at the lower end portions of the main frame and panel members. An adjustable head assembly is disposed at the upper end portions of the main frame and panel members.

An improved connector assembly is used to interconnect adjacent panel modules. The improved connector assembly includes ah elongated connector member which is positioned in a recess in a vertical edge portion of one of the panel modules. The connector member is moved upwardly and sidewardly to interconnect the one panel module with an adjacent panel module.

Accordingly, it is an object of this invention to provide a new and improved panel module for use in constructing a partition and wherein the panel module includes an adjustable base assembly and an adjustable head assembly.

Another object of this invention is to provide a new and improved method of installing panel modules by applying an upward force against a lower portion of a panel module to resiliently compress an upper portion of the panel module against a ceiling and then positioning the base of the panel module relative to a floor.

Another object of this invention is to provide a new and improved connector assembly for interconnecting a pair of panel modules and wherein the connector assembly includes a connector member which is movable upwardly and sidewardly relative to the panel modules to interconnect the panel modules.

BRIEF DESCRIPTION OF THE DRAWINGS

The foregoing and other objects and features of the present invention will become more apparent upon a consideration of the following description taken in connection with the accompanying drawings, wherein.

DESCRIPTION OF SPECIFIC PREFERRED EMBODIMENTS OF THE INVENTION

General Description

Figure 1:
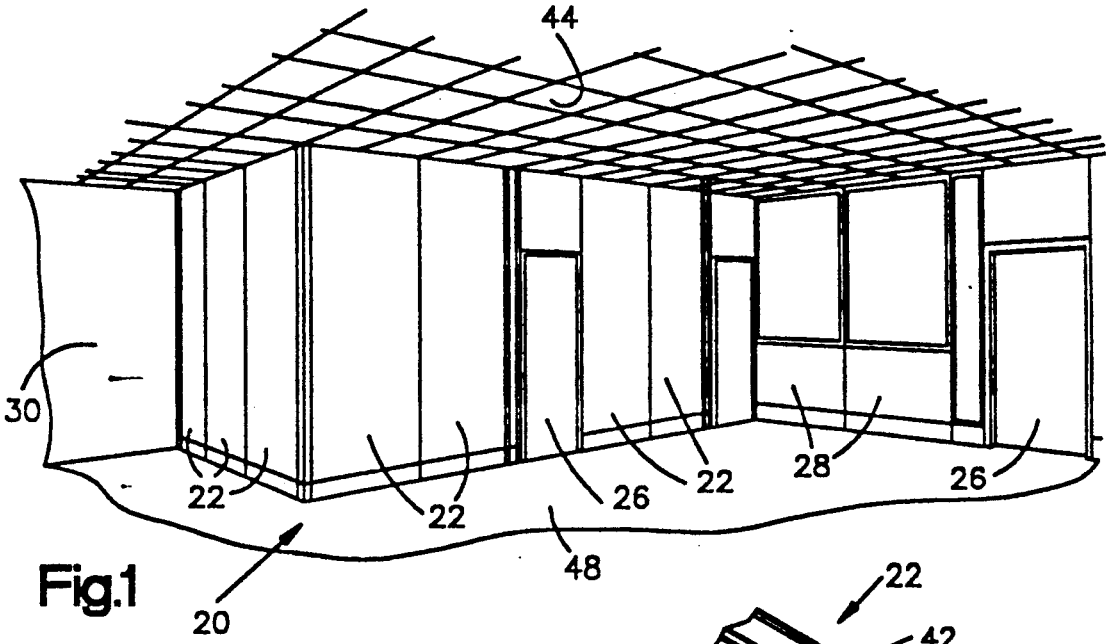
FIG. 1 is a fragmentary, somewhat schematicized, perspective illustration of a partition arrangement containing unitary panel modules.

A partition assembly 20 (FIG. 1) includes a plurality of unitary panel modules 22 (FIG. 2) constructed, installed, and interconnected in accordance with features of the present invention. Door panel modules 26 (FIG. 1) and/or window panel modules 28 could be constructed, installed, and interconnected in accordance with the present invention if desired. Although the following description will relate to the plain or solid panel modules 22, it is to be understood by those skilled in the art that the same concepts which apply to the panel modules 22 could also apply to the door and window panel modules 26 and 28.

The panel modules 22 are constructed and assembled at a location which is remote from a building 30 (FIG. 1) in which the panel modules are installed as pre-assembled units. This enables the panel modules 22 to be constructed at a factory or other location where relatively high volume production concepts can be used to efficiently and accurately construct the panel modules. The pre-assembled unitary panel modules 22 are then shipped to the building 30 where they are readily installed with a minimum of labor.

Each unitary panel module 22 (FIG. 2) includes a main panel assembly 34. The main panel assembly 34 includes a flat front panel 36 which extends parallel to a corresponding flat rear panel 38. The front and rear panels 36 and 38 each have a high density fiberglass core with a covering of fabric, vinyl or other material. If desired, a gypsum board attenuator could be provided between and extend parallel to the front and rear main panels 36 and 38. Of course, the front and rear panels 36 and 38 could be formed of other materials if desired.

A resiliently compressible head assembly 42 is connected with the upper end portion of the main panel assembly 34. The head assembly 42 engages the ceiling 44 (FIG. 1) in a building when the unitary panel module 22 is installed. The head assembly 42 (FIG. 2) is resiliently compressible vertically to facilitate installation of the unitary panel module 22 and to accommodate variations in ceiling height. The head assembly 42 cooperates with the ceiling 44 to hold the upper end of the panel module 22 in place.

An adjustable base assembly 46 (FIG. 2) is connected with the lower end portion of the main panel assembly 34. The base assembly 46 is adjustable to compensate for unevenness in the floor 48 of the building 30. The base assembly 46 can also hold any electrical circuitry associated with the panel module 22. The base assembly 46 cooperates with the floor 48 to hold the lower end of the panel module 22 in place.

A vertical support member 52 (FIG. 2) is provided in a recess at an edge portion of the main panel assembly 34. The vertical metal support member 52 connects the base assembly 46 with the main panel assembly 34 and is used to connect the panel module 22 with an adjacent panel module. Thus, the vertical support member 52 extends upwardly from a lower portion of the base assembly 46 to the head assembly 42. The vertical support member is fixedly connected with the base assembly 46 and with the main panel assembly 34. Although only the vertical support member 52 at the right (as viewed in FIG. 2) edge portion of the panel module 22 is shown, a second or left vertical support member is provided in association with the left edge portion of the panel module.

A connector member 56 (FIG. 3) cooperates with the vertical support members 52 in a pair of adjacent panel units 22 to interconnect the panel units. The metal connector member 56 is inserted into a recess in a vertical support member 52 at one edge portion of a panel module 22. Thus, the connector member 56 is illustrated in FIG. 4 as being disposed in a recess in the right edge portion of the panel module 22. However, the connector member 56 could be inserted into a recess in the left edge portion of the panel module 22. The connector member 56 is disposed entirely within a recess to permit removal of any individual panel module 22 from the partition assembly 20 without disturbing adjacent panel modules.

The unitary connector member 56 (FIG. 3) has a plurality of hooks 60 which extend from one side of the connector member. The hooks 60 are inserted into slots 62 (FIG. 2) in the vertical support member 52 to support the connector member in the recessed edge portion of the panel module 22 in the manner shown in FIG. 4. When the panel module 22 is to be connected with an adjacent panel module, force is applied to an actuator surface formed by a hole or opening 64 (FIG. 3) in the lower end portion of the connector member 56 to raise the connector member. As the connector member moves upwardly, cam surfaces cause the connector member to move sidewardly so that slots in the connector member are engaged with hooks on the adjacent panel module 22 to interconnect the panel modules.

Installation

In accordance with one of the features of the invention, the unitary panel module 22 (FIG. 2) is constructed at a factory or other location remote from the building 30 (FIG. 1). The fully assembled panel module 22 is then transported to the building 30 where it is to be installed. In order to enable the fully assembled and unitary panel module 22 to be connected with an adjacent unitary panel module, the connector member 56 is placed in a recess at one end, the right end as viewed in FIG. 4, of the unitary panel module 22. The unitary panel module 22 is then tilted relative to the floor 48 and ceiling 44 in the manner shown in FIG. 5. While the unitary panel module 22 is tilted and the base assembly 46 is above the floor 48, the head assembly 42 or upper end portion of the panel module 22 is moved to a desired location relative to the ceiling 44.

Figure 5:
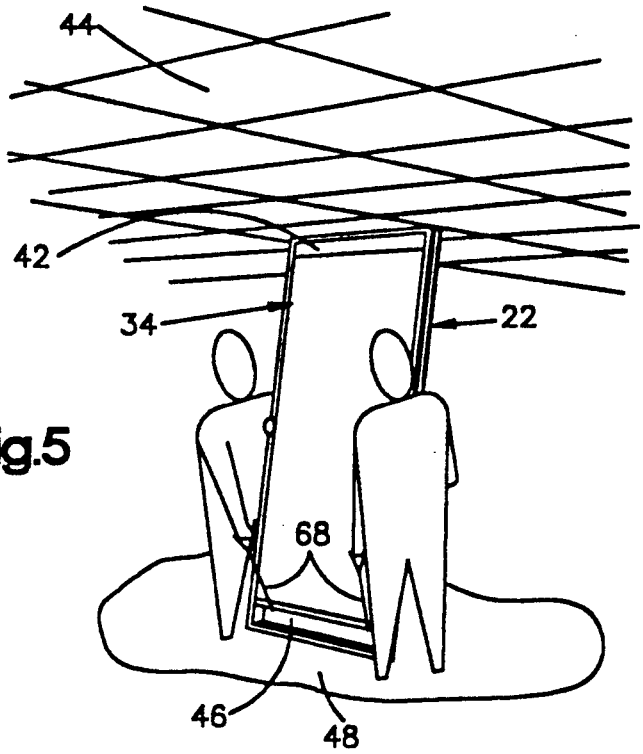
FIG. 5 (on sheet 3 of the drawings) is a schematic illustration depicting the manner in which the unitary panel module of FIG. 2 is installed in a building.

Once the head assembly 42 has been positioned in the desired location relative to the ceiling 44, an upwardly directed force is applied against the base assembly 46 on the tilted panel module 22 (FIG. 5). This force resiliently compresses the head assembly 42 against the ceiling 44. The manual application of the upwardly directed force the base 46 of the panel module 22 is facilitated by the use of installation tools 68.

The installation tools 68 are rigid rods having hooks at their lower ends and handles at their upper ends. By engaging the hooks at the lower ends of the installation tools 68 with the base assembly 46 and pulling upwardly on the handles, an upwardly directed force is applied to the base assembly to compress the head assembly 42 against the ceiling 44. Of course, the upwardly directed force could be applied to the tilted panel module 22 in a different manner if desired.

Due to the resilient compression of the head assembly 42, there is space between the base assembly 46 and the floor 48. This space allows the panel module 22 to be swung from the tilted position to an upright position without dragging the base assembly 46 on the floor 48. Of course, the upward force is maintained during the pivoting or swinging movement of the panel module 22 to maintain the head assembly 42 compressed against the ceiling 44. It is believed that this method of installation will be particularly advantageous when the panel module 22 is to be installed on the carpeted floor 48.

When the panel module 22 has been moved to a vertical orientation, the upward force against the base assembly 46 is gradually reduced. This results in the base assembly 46 moving downwardly into engagement with the carpeted floor 48. As the base assembly 46 moves downwardly, the head assembly 42 resiliently expands to maintain engagement with the ceiling 44. Once the base assembly 46 has been moved to the desired position relative to the floor 48, leveling screws in the base assembly are adjusted to compensate for any unevenness in the floor. When the installation is completed, the head assembly 42 will still be compressed somewhat to provide an upwardly directed force against the ceiling 44.

An adjacent panel module 22 (not shown) is then installed next to the first panel module 22 in the same manner as previously explained for the first panel module. The left end portion of the adjacent panel module will abut the right end portion of the first panel module. To interconnect the two panel modules, the connector member 56 (FIG. 3) in the recess in the right end portion of the first panel module 22 (FIG. 4) is raised and moved sidewardly to interconnect the two panel modules in a manner which will be more fully explained in conjunction with FIGS. 11-19 of the drawings.

After the two panel modules 22 have been interconnected, a final adjustment of the leveling screws in the base assemblies 46 of the two panel modules is performed. After any desired electrical circuitry has been installed in the base assemblies 46 of the panel modules 22, trim panels are snapped into place on the base assemblies of the panel modules to complete the installation.

Panel Module—Main Panel Assembly

Figure 2:
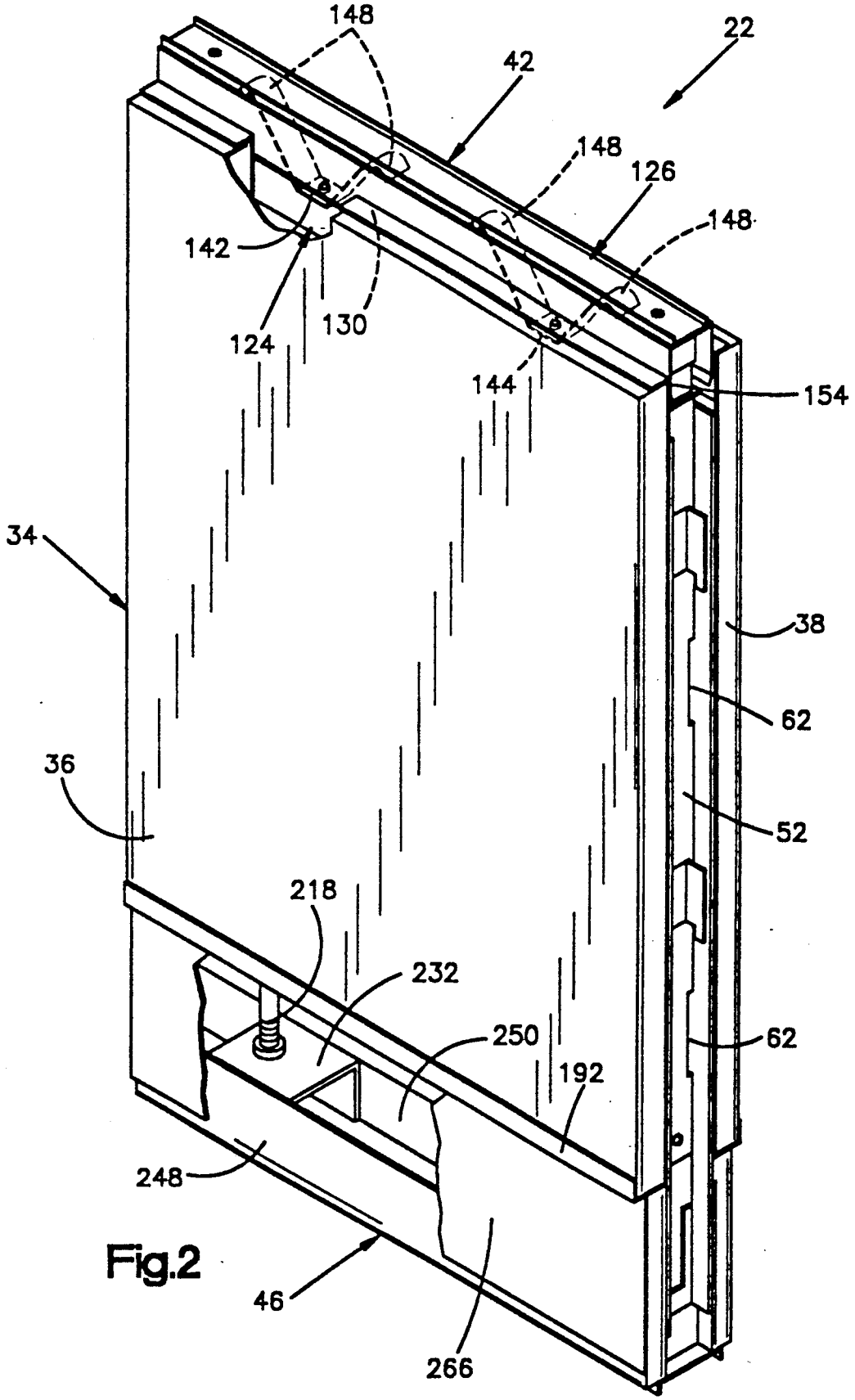
FIG. 2 is a partially broken away illustration of a unitary panel module constructed in accordance with the present invention.
Figure 6:
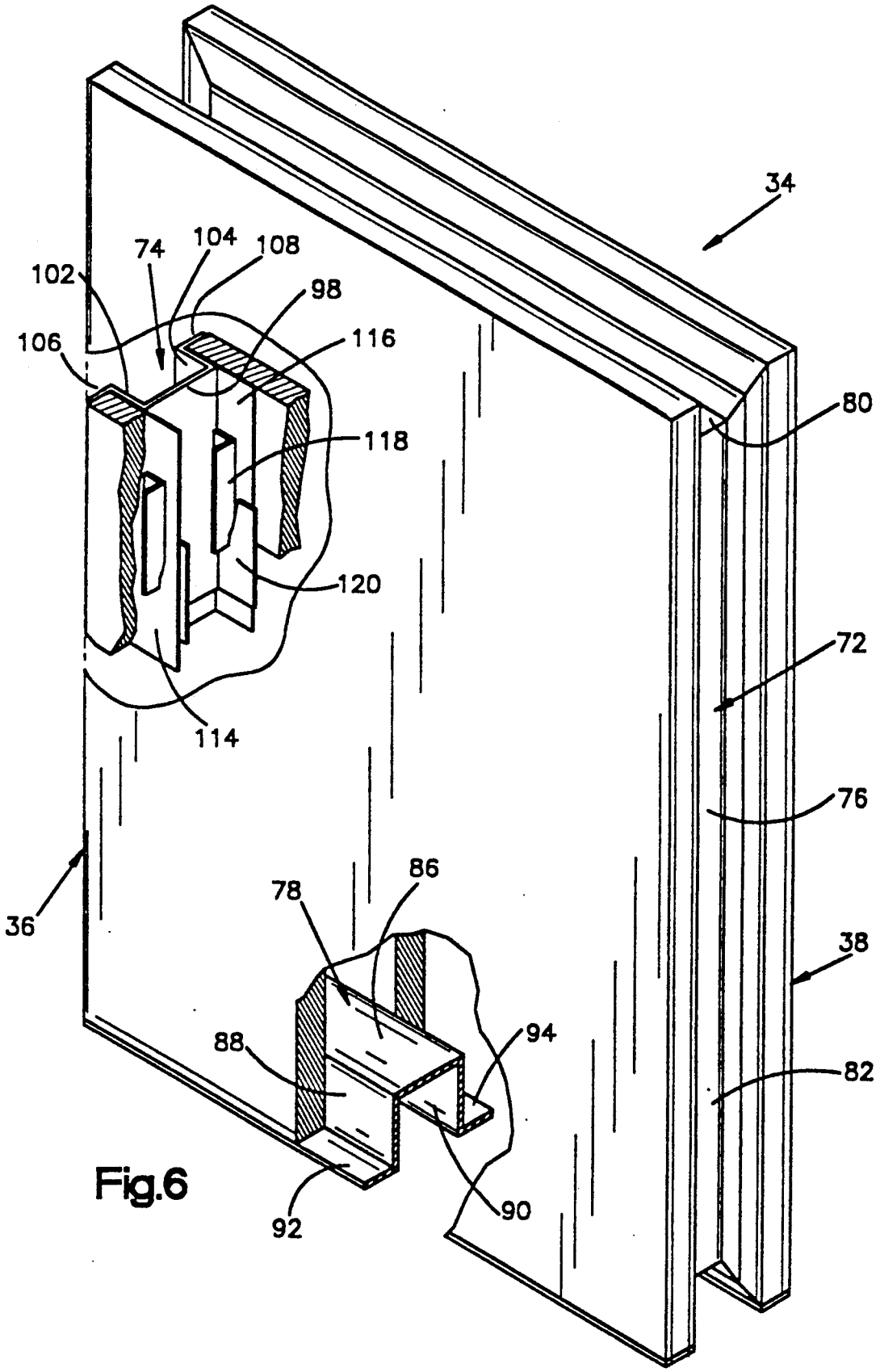
FIG. 6 is a fragmentary illustration of a main panel assembly which forms a portion of the unitary panel module of FIG. 2.

The unitary panel module 22 (FIG. 2) includes a main panel assembly 34 (FIGS. 2 and 6). The main panel assembly 34 includes a rectangular main frame 72 (FIG. 6). The flat parallel front and rear main panels 36 and 38 are connected with the metal main frame 72 to form the main panel assembly 34.

The main frame 72 has an open center rectangular configuration. Thus, the main frame 72 is formed by a plurality of metal frame sections which are interconnected and are disposed adjacent edge portions of the front and rear main panels 36 and 38. A pair of vertical main frame sections 74 and 76 (FIG. 6) extend along opposite vertical edge portions of the front and rear main panels 36 and 38. Similarly, a pair of horizontal upper and lower main frame sections 78 and 80 extend along upper and lower edge portions of the main panels 36 and 38.

The frame sections 74, 76, 78 and 80 of the main frame 72 define a continuous rectangular outwardly opening recess 82 which extends around the perimeter of the main panel assembly 34. The recess 82 is disposed between the front and rear main panels 36 and 38. The recess 82 extends completely around the edge portion of the main panel assembly 34 and has a rectangular cross sectional configuration throughout its length. The recess 82 (FIG. 6) is somewhat deeper at the upper and lower end portions of the main panel assembly 34 to enable the recess to receive components of the head assembly 42 and base assembly 46.

The metal lower frame section 78 (FIG. 6) has a rectangular inner wall or web panel 86. The web panel 86 is disposed between and extends perpendicular to inner side surfaces of the front and rear main panels 36 and 38. Parallel front and rear flange sections 88 and 90 extend downwardly from the web panel 86. The front and rear flange sections 88 and 90 have outer side surfaces which are disposed in flat abutting engagement with inner side surfaces of the front and rear main panels 36 and 38.

Front and rear edge sections 92 and 94 extend from the flange sections 88 and 90. The front and rear edge sections 92 and 94 overlap lower edges of the front and rear main panels 36 and 38. Thus, the lower edge portions of the front and rear main panels 36 and 38 rest on the edge sections 92 and 94 of the lower frame section 78 while the inner side surfaces of the front and rear main panels are disposed in abutting engagement with the flange sections 88 and 90. A suitable adhesive is used to connect the front and rear panels 36 and 38 with the flange sections 88 and 90 and edge sections 92 and 94 of the lower frame section 78.

The upper frame section 80 is disposed adjacent to the upper edges of the front and rear main panels 36 and 38 and extends parallel to the lower frame section 78. The upper frame section 80 has the same construction as the lower frame section 78. Thus, the upper frame section has front and rear flange sections which extend upwardly along the inner side surfaces of the front and rear main panels 36 and 38 from an inner wall or web panel. Edge sections of the upper frame section 80 overlap the upper edges of the front and rear panels 36 and 38 in the same manner as in which the edge sections 92 and 94 of the lower frame section 78 overlap the lower edges of the front and rear main panels.

The left vertical frame section 74 of the main panel assembly 34 (FIG. 6) extends between and is connected to the left ends of the lower and upper frame sections 78 and 80. The metal vertical frame section 74 includes an inner wall or web section 98 which extends perpendicular to inner side surfaces of the front and rear main panels 36 and 38. The front and rear side flanges 102 and 104 extend perpendicular to the web panel 98 along the inner side surfaces of the front and rear main panels 36 and 38. Front and rear edge sections 106 and 108 overlap the vertical left edge portions of the front and rear main panels 36 and 38.

The right vertical frame section 76 has the same construction as the left frame section 74 and is connected to the right ends of the lower and upper frame sections 78 and 80. Thus, the right frame section 76 includes an inner wall or web panel which extends perpendicular to the front and rear main panels 36 and 38. The right frame section 76 also has front and rear side flanges which extend vertically along the inner side surfaces of the front and rear main panels 36 and 38. The front and rear edge sections of the right frame section 76 overlap the right edges of the main panels 36 and 38.

In the illustrated embodiment of the main panel assembly 34, a fabric covering extends over the main panels 36 and 38. The fabric covering over the front main panel 36 also extends across the edge portions 92 and 106 onto the flange sections 88 and 102 of the frame sections 72, 74, 78 and 80. Similarly, the fabric covering over the rear panel 38 extends over the edge sections 94 and 108 and over the flange sections 90 and 104 of the main frame sections 72, 74, 78 and 80. The fabric covering over the front and rear main panels 36 and 38 is secured to the metal frame sections by a suitable adhesive.

Although the embodiment of the invention illustrated in FIG. 6 has a fabric covering over the front and rear main panels 36 and 38, a covering of a different material could be used if desired. For example, a covering of a vinyl or similar material could be provided over the front and rear main panels 36 and 38. Although it is preferred to have the coverings extend over the various sections of the main frame 72, it is contemplated that the coverings could be applied over just the main panels 36 and 38 and be enclosed by the edge portions of the main frame 72.

The front and rear main panels 36 and 38 are connected with the main frame 72. Thus, a plurality of mounting flanges 114 and 116 (FIG. 6) extend inwardly from the sections of the main frame 72. The flanges 114 and 116 abut the inner side surfaces of the front and rear main panels 36 and 38. Brackets 118 extend inwardly from the front and rear main panels 36 and 38 through openings in the mounting flanges 114 and 116. Mounting clips 120 engage the brackets 118 to hold the front and rear main panels 36 and 38 in place. Although only a single mounting flange 116 has been shown in FIG. 6 for connecting the front and rear main panels 36 and 38 with the main frame 72 at one location, it should be understood that there are a plurality of mounting flanges provided about the main frame 72 to interconnect it with the front and rear main panels 36 and 38. It should also be understood that the panels 36 and 38 could be connected with the main frame 72 in a manner other than the specific manner illustrated in FIG. 6.

The size of the main panel assembly 34 is such as to enable the unitary panel module 22 to extend from the floor 48 to the ceiling 44 in a building 30 (FIG. 1). Assuming an eight foot ceiling height, the main panel assembly 34 would have a height of approximately seven and one-half (7.5) feet. The partially compressed head assembly 42 and the base assembly 46 would provide the remaining one-half (0.5) foot of height.

The main panel assembly 34 could have many different widths. However, the illustrated embodiment of the main panel assembly 34 is constructed with a width of three (3) feet. The distance between outer side surfaces of the front and rear panels 36 and 38 of this embodiment of the main panel assembly is three (3) inches.

It should be understood that the foregoing specific dimensions for the main panel assembly 34 and panel module 22 have been set forth herein for purposes of clarity of description. It is contemplated that the main panel assembly 34 and panel module 22 will be constructed with dimensions other than these specific dimensions. Therefore, the invention is not to be considered as being limited to any specific dimensions.

Panel Module—Head Assembly

The head assembly 42 (FIGS. 7 and 8) is resiliently compressible to facilitate installation by swinging of the panel module 22 into place without dragging on the floor (FIG. 5). In addition, the resiliently compressible head assembly 42 accommodates variations in ceiling structure and heights. The upwardly directed force applied by the partially compressed head assembly 42 against the ceiling 44 enables the head assembly to securely grip the ceiling and hold the upper end of the installed panel module 22 against sideward movement.

Figure 7:
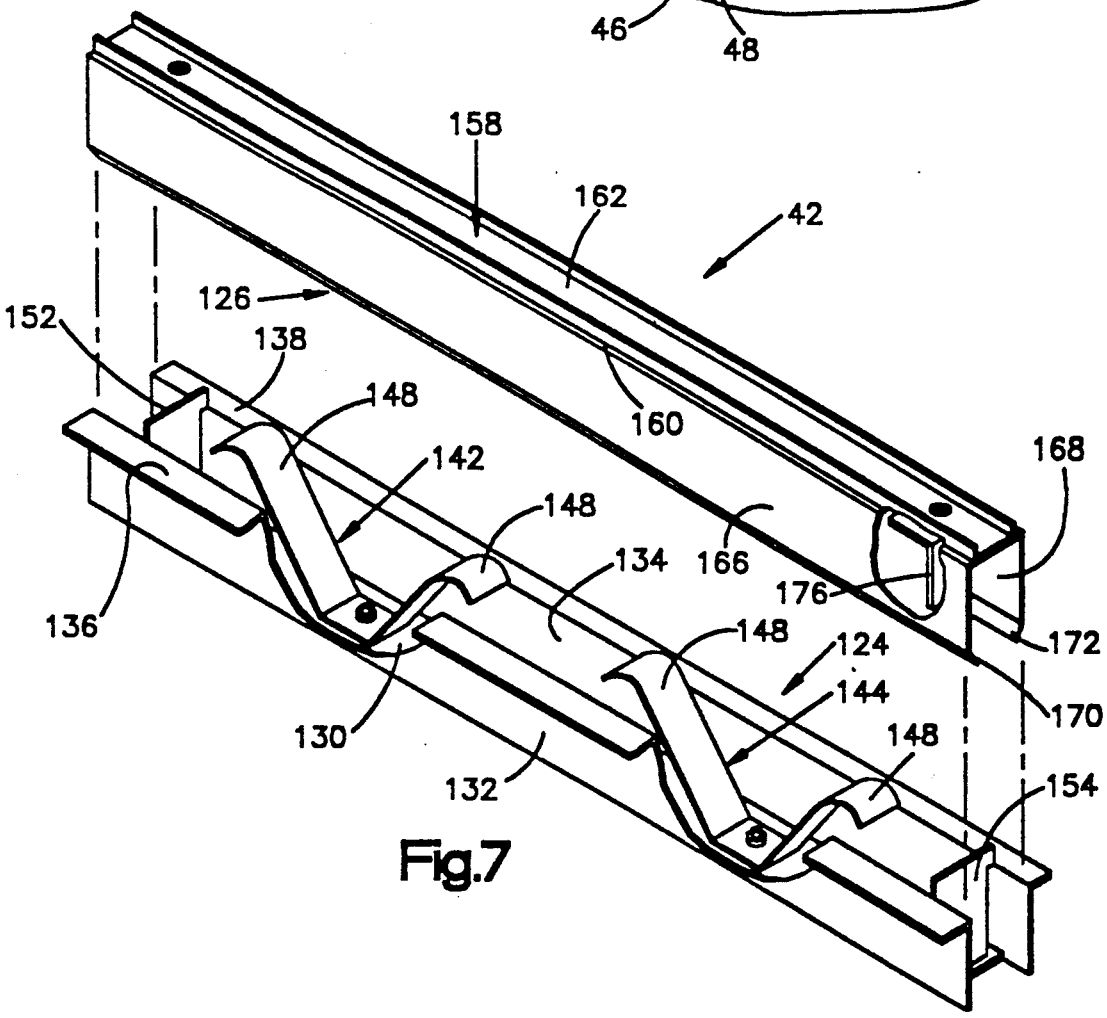
FIG. 7 (on sheet 3 of the drawings) is a partially exploded and broken away illustration of a resiliently compressible upper end portion or head assembly which forms part of the unitary panel module of FIG. 2.
Figure 8:
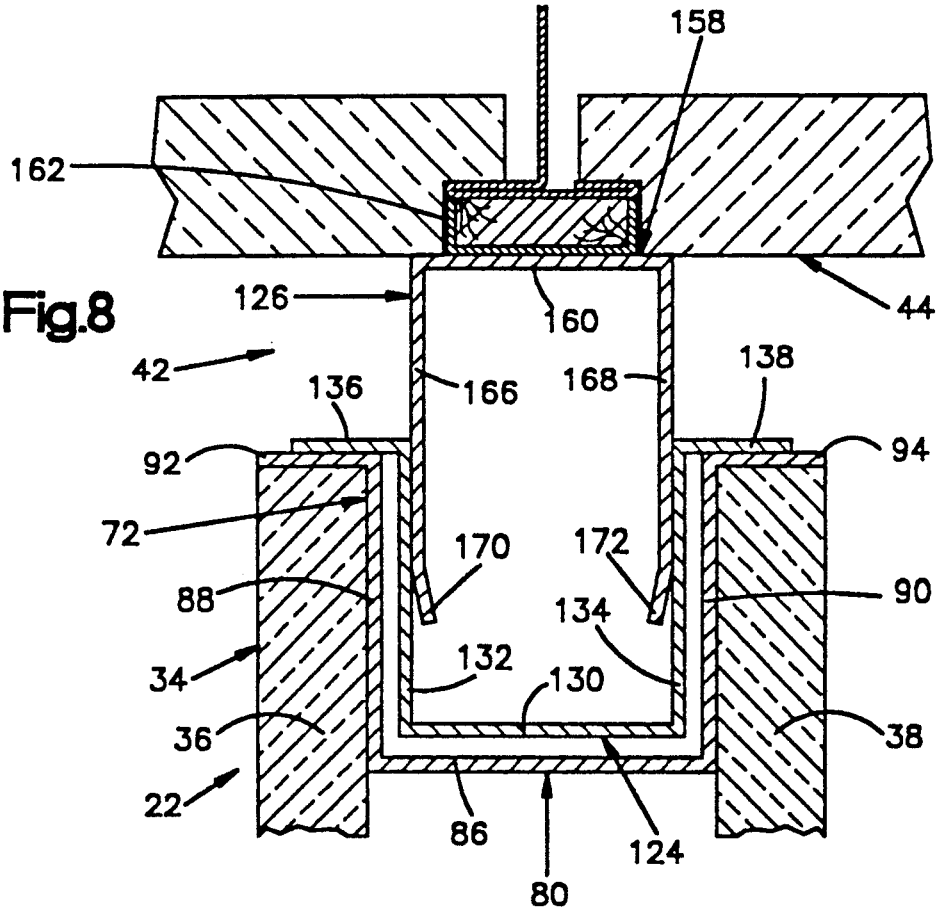
FIG. 8 (on sheet 5 of the drawings) is a fragmentary sectional view illustrating the manner in which the head assembly of FIG. 7 engages a ceiling structure when the panel module of FIG. 2 is installed.

The resiliently compressible head assembly 42 (FIGS. 7 and 8) includes a metal base section 124 which is received in an upwardly opening recess in the upper frame section 80 of the main frame 72 (FIG. 8). A metal extension section 126 (FIGS. 7 and 8) is telescopically received in the base section 124. The extension section 126 is movable up and down relative to the base section 124 to vary the vertical extent of the panel module 22.

In one specific embodiment of the invention, the extension section 126 was movable through a vertical distance of a little more than one inch relative to the base section 124. Of course, the head assembly 22 could be constructed so as to enable the extension section 126 to move through any desired distance relative to the base secton 124. Therefore, the invention is not to be considered as being limited to a specific range of telescopic movement between the base and extension sections 124 and 126.

The base section 124 of the head assembly 42 includes a flat horizontal web section 130. The web section 130 extends perpendicular to the main panels 36 and 38 and parallel to the inner wall section 86 of the upper main frame section 80 (FIG. 8). The web section 130 is attached to the web panel 86 of the main frame section 80 by suitable fasteners (not shown), such as self-tapping sheet metal screws.

Front and rear panel sections 132 and 134 (FIGS. 7 and 8) extend perpendicular to the web or lower panel section 130 and parallel to the flange sections 88 and 90 (FIG. 8) of the upper main frame section 80. Front and rear edge sections 136 and 138 extend from the flange sections 132 and 134. The front and rear edge sections 136 and 138 overlie the edge portions 92 and 94 in the upper main frame section 80 and the upper ends of the front and rear main panels 36 and 38 (FIG. 8).

In order to urge the extension section 126 upwardly toward the ceiling 44, a plurality of leaf springs 142 and 144 (FIG. 7) are mounted on the web section 130 of the base member 124. The leaf springs 142 and 144 have upwardly projecting arms 148 which engage the extension section 126 to urge the extension section upwardly (FIG. 2). The leaf springs 142 and 144 are resiliently compressible to enable the extension section 126 to be telescopically retracted into the base section 124 when the head assembly 42 is pressed against a ceiling structure 44 during installation of the unitary panel module 22. After the panel module 22 has been installed, the leaf springs 142 and 144 are still compressed to some extent to press the extension section 126 against the ceiling 44.

A pair of upwardly projecting locating brackets 152 and 154 (FIG. 7) are provided between the front and rear panel sections 132 and 134 of the base section 124. The locating flanges 152 and 154 have lower end portions which are secured to the web panel 130.

The extension section 126 (FIGS. 7 and 8) has an upper end portion 158 which is pressed against the ceiling structure 44 by the leaf springs 142 and 144. The upper portion 158 of the extension section 126 includes a flat upper panel 160 with an upwardly facing, generally U-shaped, positioning strip 162. The positioning strip 162 is engageable with the ceiling structure 44 to locate the head assembly 42 relative to the ceiling structure (FIG. 8). The positioning strip 162 holds the upper end of the panel module 22 against sidewise movement relative to the ceiling 44.

Front and rear side panels 166 and 168 extend downwardly from and are perpendicular to the upper panel 160. The side panels 166 and 168 have outer side surfaces which slidably engage the inner side surfaces of the front and rear panel sections 132 and 134 of the base section 124. The front and rear side panels 166 and 168 of the extension section 126 have inwardly bent flanges 170 and 172 which engage sidewardly extending upper ends of the locating brackets 152 and 154 (FIG. 7) to limit upward movement of the extension section 126 under the influence of the leaf springs 142 and 144.

A pair of locating brackets 176 (only one of which is shown in FIG. 7) are connected with and extend downwardly from the upper side wall 160 of the extension section 126. The downwardly extending locating brackets 176 engage outer side surfaces of the locating members 152 and 154 of the base section 124. The locating brackets 176 cooperate with the locating members 152 and 154 to hold the extension section 126 against axial movement, that is movement in a direction parallel to the major side surfaces of the front and rear panels 132 and 134 of the base section 124.

Panel Module—Base Assembly

The base assembly 46 (FIGS. 9 and 10) supports the main panel assembly 34 of the unitary panel module 22 (FIG. 2). The base assembly 46 is adjustable to compensate for variations in the evenness of the floor 48 of the building in which the panel module 22 is installed. In addition, the base assembly 46 holds any electrical circuitry which is to be associated with the panel module 22. The main panel assembly 34, head assembly 42 and base assembly 46 all have the same length.

The base assembly 46 (FIGS. 9 and 10) includes an upper end portion 180 and a lower end portion 182. The metal upper end portion 180 is connected with the main panel assembly 34 (FIG. 10). The metal lower end portion 182 engages the floor 48 and telescopically receives the upper end portion 180 of the base assembly. The extent of the telescopic relationship between the upper and lower end portions 180 and 182 of the base assembly 46 can be varied along the length of the base assembly to compensate for unevenness in the floor 48.

The upper end portion 180 includes a panel support member 186 (FIGS. 9 and 10) which supports the main panel assembly 34. The panel support member 186 includes a generally horizontal web section 188 which extends across the lower ends of the main panels 36 and 38 (FIG. 10). Front and rear flanges 192 and 194 extend upwardly from the web section 188 and overlap the front and rear major side surfaces of the main panels 36 and 38. Engagement of the front and rear flanges 192 and 194 with the main panels 36 and 38 covers or finishes the lower edge portions of the main panels.

A locating section 196 (FIGS. 9 and 10) is connected to the web section 188 and is received in the lower portion of the recess 82 in the main panel assembly 34 (FIG. 10). The locating section 196 includes a horizontal connector panel 198 which is disposed adjacent to and extends parallel to the inner wall 86 of the lower frame section 78 of the main frame 72 (FIG. 10). The connector panel 198 extends perpendicular to the downwardly extending front and rear flange sections 88 and 90 of the main frame section 78.

Front and rear locating panels 202 and 204 (FIGS. 9 and 10) engage inner side surfaces of the front and rear flanges 88 and 90 (FIG. 10) on the lower section 78 of the main frame 72. A pair of horizontal flanges 206 and 208 extend outwardly from the lower ends of the locating panels 202 and 204. The flanges 206 and 208 are disposed between the front and rear edge sections 92 and 94 of the lower frame section 72 and the web section 188 of the panel support member 186. The flanges 206 and 208 are welded to the web section 188 of the panel support member 186.

At opposite ends of the upper end portion 180 of the base assembly 46, a pair of upwardly projecting mounting elements 212 and 214 (FIG. 9) extend perpendicular to the web section 188. Internally threaded fasteners, that is, nuts, are secured to the upwardly extending mounting elements. Suitable bolts extend through holes in the vertical support members 52 (FIG. 2) to connect the support members 52 with the mounting elements 212 and 214 in the base assembly 46. The vertical support members 52 extend upwardly from the base assembly 46 to the head assembly 42.

In one embodiment of the invention, the upper end portions of the vertical support members 52 were attached to the main frame 72 of the main panel assembly 34. Thus, the left vertical support, member 52 was attached to the web section 98 (FIG. 6) of the vertical frame section 74 of the main frame 72 by a self-tapping sheet metal screw. The right vertical support member 52 was similarly attached to the right frame section 76 of the main frame 72. However, it is contemplated that the upper end portions of the vertical support members 52 could also be connected to the head assembly 42 if desired. Thus, the vertical support members 52 could be attached to both the main frame 76 and head assembly 42 or to just the head assembly 42 or to just the main frame 76.

A pair of leveling screws 218 and 220 (FIG. 9) extend downwardly from and are freely rotatable relative to the web section 188 of the panel support member 186. An annular flange 222 (FIG. 10) is fixedly connected with each of the leveling screws 218 and 220 to support the web section 188 of the panel support member 186. A cotter key 224 (FIG. 10) is provided at the upper end of each of the leveling screws 218 and 220 to hold the leveling screws in place while allowing them to rotate freely about their central axes.

Figure 9:
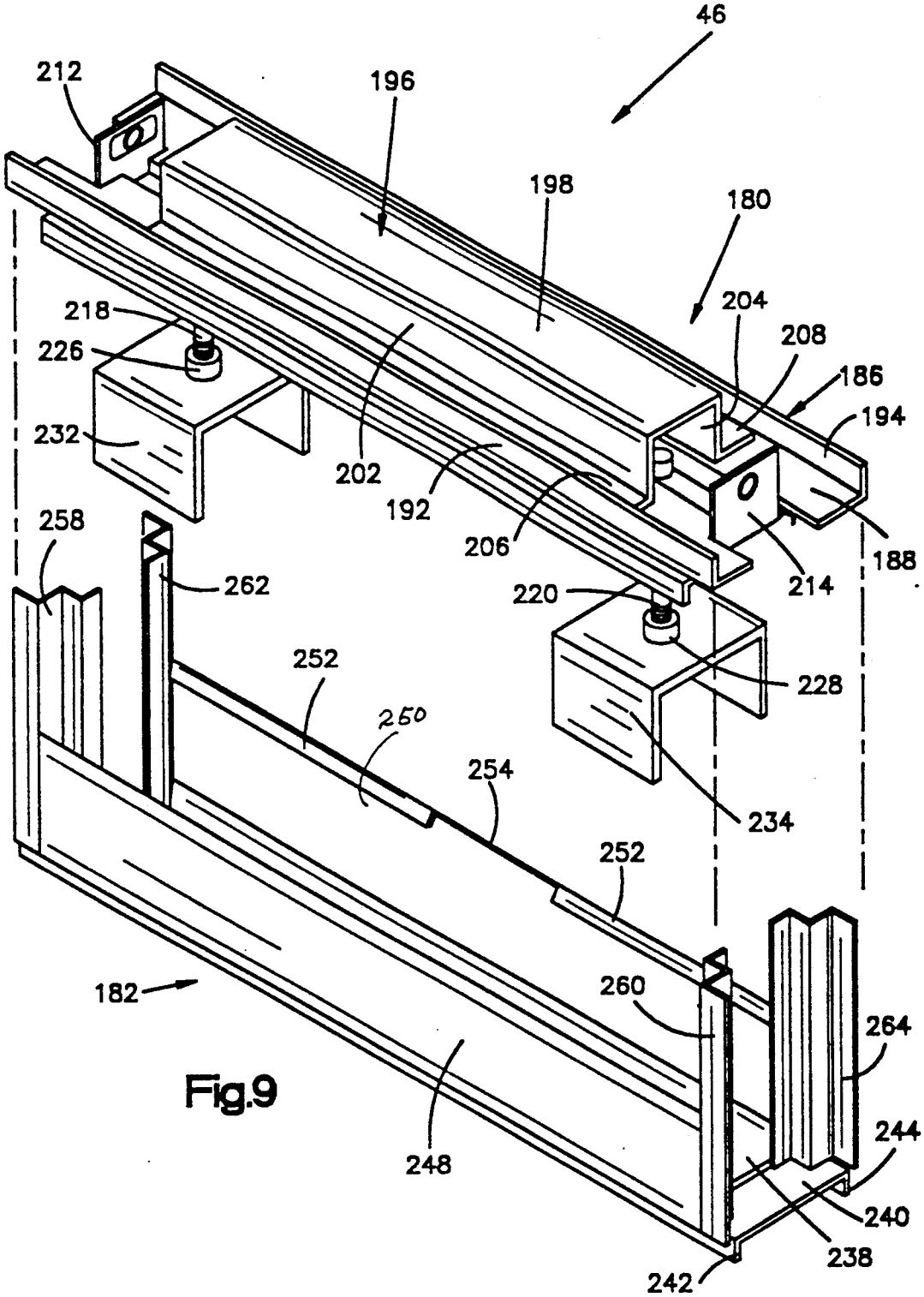
FIG. 9 is a partially exploded illustration of a base assembly which forms a portion of the unitary panel module of FIG. 2.
Figure 10:
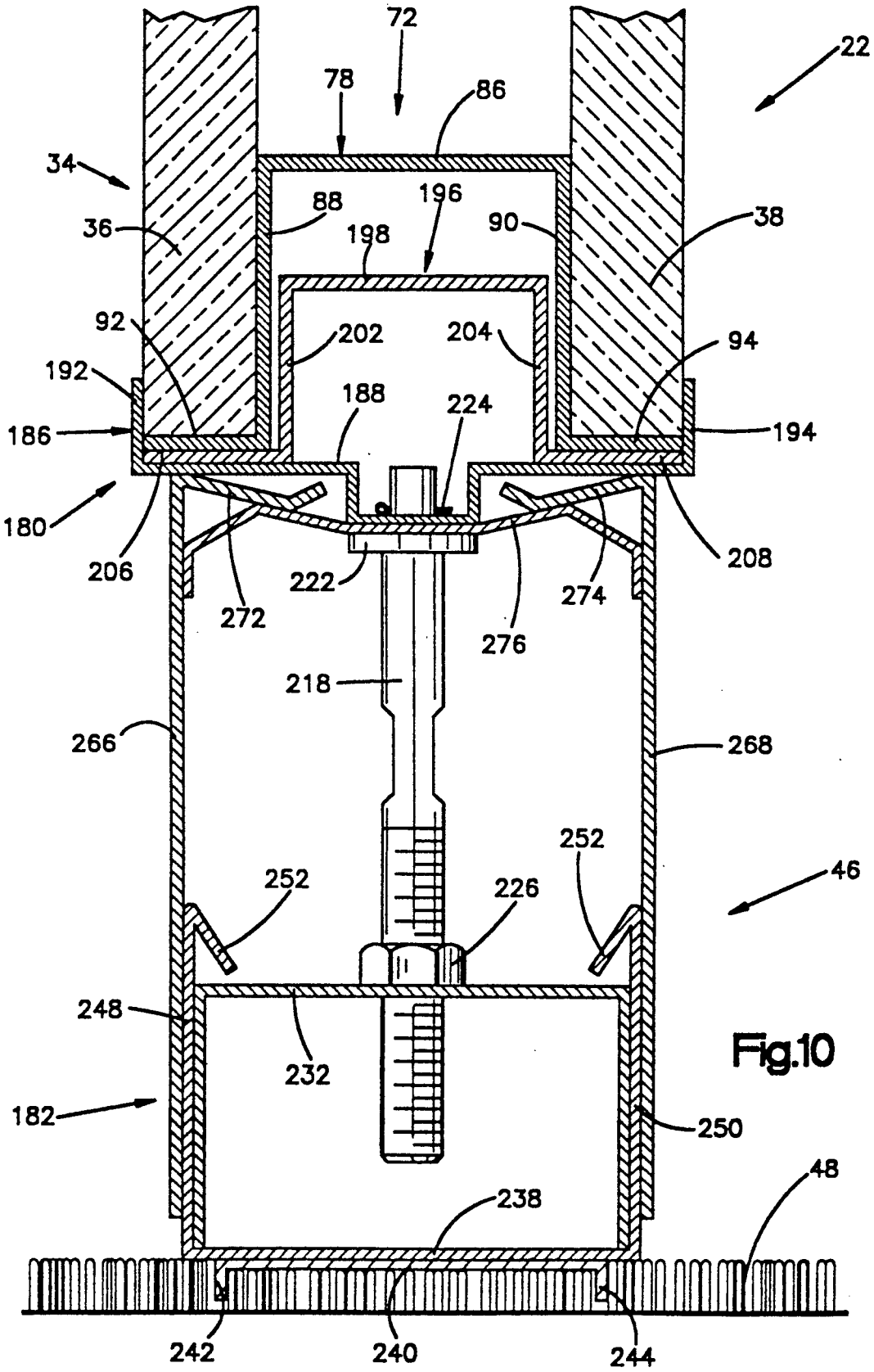
FIG. 10 is a fragmentary sectional view illustrating the manner in which the base assembly of FIG. 9 engages a carpeted floor when the panel module of FIG. 2 is installed.

The lower ends of the leveling screws 218 and 220 are threaded into nuts 226 and 228 (FIG. 9). The nuts 226 and 228 are fixedly connected to the upper span of saddle members 232 and 234. By rotating the leveling screws 218 and 220, the threaded lower end portions of the leveling screws cooperate with the nuts 226 and 228 on the saddle members 232 and 234 to raise or lower the portion of the panel support member 186.

The lower end portion 182 of the base assembly 46 provides a base for the panel module 22. In addition, the lower end portion 182 guides movement of the upper end portion 180 of the base assembly 46 when the leveling screws 218 and/or 220 are rotated to adjust the base assembly.

The lower end portion 182 of the base assembly includes a flat bottom panel 238. A locating or positioning panel 240 is connected to the bottom panel 238. The locating or positioning panel 240 has downwardly projecting front and rear flanges 242 and 244 to engage the carpeted floor 48 (FIG. 10) to hold the base assembly 46 against sideward movement relative to the carpet.

Front and rear side panels 248 and 250 extend vertically upwardly from the bottom panel 238 (FIGS. 9 and 10). The vertical side panels 248 and 250 cooperate with the bottom panel 238 to form a generally rectangular trough in which the saddles 232 and 234 are received. To retain the saddles 232 and 234 against vertical upward movement from the trough in the lower end portion 182, the front and rear side panels 248 and 250 have inwardly turned lips or edge portions 252 (FIG. 10) which extend over the saddles 248. The in-turned lips 252 on each of the side panels 248 and 250 are separated by a recess 254 (FIG. 9) which enables the saddles 232 and 234 to be inserted past the lips and moved sidewardly in the trough into alignment with the leveling screws.

Upstanding front side guides 258 and 260 cooperate with upstanding rear side guides 262 and 264 (FIG. 9) to engage opposite sides of vertical support members 52 (FIG. 2) extending downwardly from opposite vertical edge portions of the main panel assembly 34. The side guides 258-264 cooperate with the vertical support members 52 to guide relative movement between the upper end portion 180 and the lower end portion 182 of the base assembly 46 when the leveling screws 218 and 220 are adjusted.

Front and rear trim panels 266 and 268 (FIG. 10) are snapped in place to cover the exposed sides of the base assembly 46 after the leveling screws 218 and 220 have been adjusted and any electrical circuitry mounted in the base assembly. To hold the front and rear trim panels 266 and 268 in place, inwardly projecting flanges 272 and 274 on the front and rear trim panels snap into recesses formed by cooperation of a retaining panel 276 with the web section 188 of the panel support 186.

Connector Assembly

An improved connector assembly 300 (FIGS. 11-19) is provided to interconnect a pair of adjacent panel modules. In FIGS. 11-19, vertical support members 302 and 304 have been shown separate from their associated panel modules 22 for purposes of clarity of illustration. The vertical support member 302 has the same construction as the vertical support member 52 of FIG. 2. Although the improved connector assembly 300 is advantageously used with the panel module 22, it is contemplated that the connector assembly could be used with different panel modules and/or partition components if desired.

The vertical support member 302 is received in a recess formed in the right edge portion of a main panel assembly in the same manner as is the vertical support member 52 of FIG. 2. The vertical support member 304 is identical to the vertical support member 302 and is received in a recess in the left edge portion of a main panel assembly in the same manner that the vertical support member 302 is received in a recess in the right edge portion of a main panel assembly. Each of the metal support members 302 and 304 is symmetrical about its vertical central axis. Therefore, the vertical support member 302 can be oriented for association with the right edge portion of a main panel assembly or can be oriented for association with the left edge portion of a main panel assembly.

Figure 3:
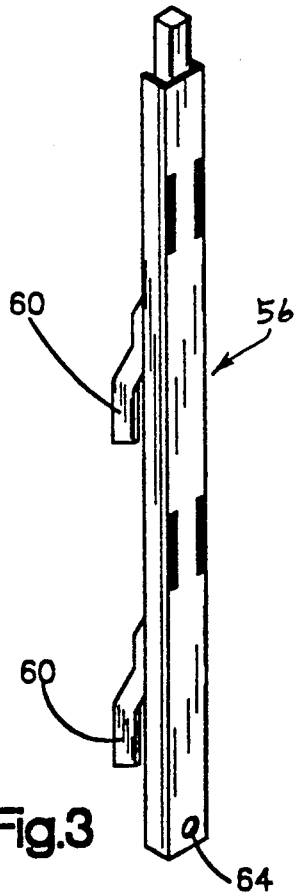
FIG. 3 (on sheet 1 of the drawings) is an illustration of an improved connector member used to interconnect a pair of unitary panel modules constructed in accordance with FIG. 2 to form a portion of the partition of FIG. 1.
Figure 4:
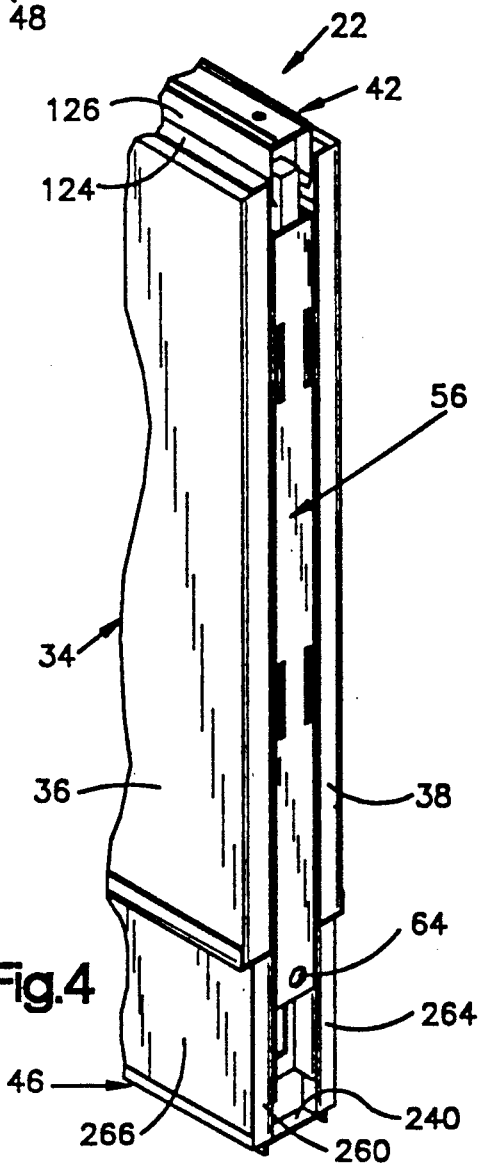
FIG. 4 is an illustration depicting the manner in which the connector member of FIG. 3 is mounted in a recess in a vertical edge portion of the unitary panel module of FIG. 2.

The connector member 306 has the same construction as the connector member 56 of FIG. 3. The metal connector member 306 is symmetrical about its longitudinal central axis. Therefore, the connector member 306 can be initially connected with the vertical support member 302 or the vertical support member 304 and then moved sidewardly into engagement with the other vertical support member.

The vertical support member 302 is connected with the left panel module 22 of a pair of adjacent panel modules. The vertical support member 304 is connected with the right panel module 22 of a pair of adjacent panel modules. Therefore, the vertical support members 302 and 304 will be referred to hereinafter as the left and right vertical support members, respectively. However, it should be understood that the vertical support member 302 is mounted in the recess at the right edge portion of a main panel assembly 34. Similarly, the vertical support member 304 is mounted in the recess at the left edge portion of a main panel assembly 34.

The left vertical support member 302 (FIG. 11) includes a flat web section 312. A pair of parallel front and rear flanges 314 and 316 extend from the web section 312. The flanges 314 and 316 extend perpendicular to major side surfaces of the web section. The flanges 314 and 316 extend throughout the entire length of the metal support member 302. Thus, the flanges 314 and 316 extend from a location in the base assembly 46 vertically upwardly to the head assembly 42 of a unitary panel module 22.

A plurality of vertically extending slots 318 and 320 are formed in the web section 312. Although only a single pair of slots 318 and 320 has been shown in FIG. 11, it should be understood that there are a plurality of pairs of slots 318 and 320 along the length of the web 312 of vertical support member 302.

A pair of hooks 324 and 326 (FIGS. 11 and 12) extend outwardly from the inner sides of the web 312 and ar disposed between the flanges 314 and 316. The hooks 324 and 326 have the same configuration and extend parallel to each other. Although only a pair of hooks 324 and 326 have been shown in FIG. 11, it should be understood that there are a plurality of pairs of hooks 324 and 326 along the length of the web 312. The hooks are spaced from the flanges 314 and 316. Therefore, channels are formed between the outer major side surfaces of the hooks 324 and 326 and the inner side surfaces of the flanges 314 and 316.

Figure 11:
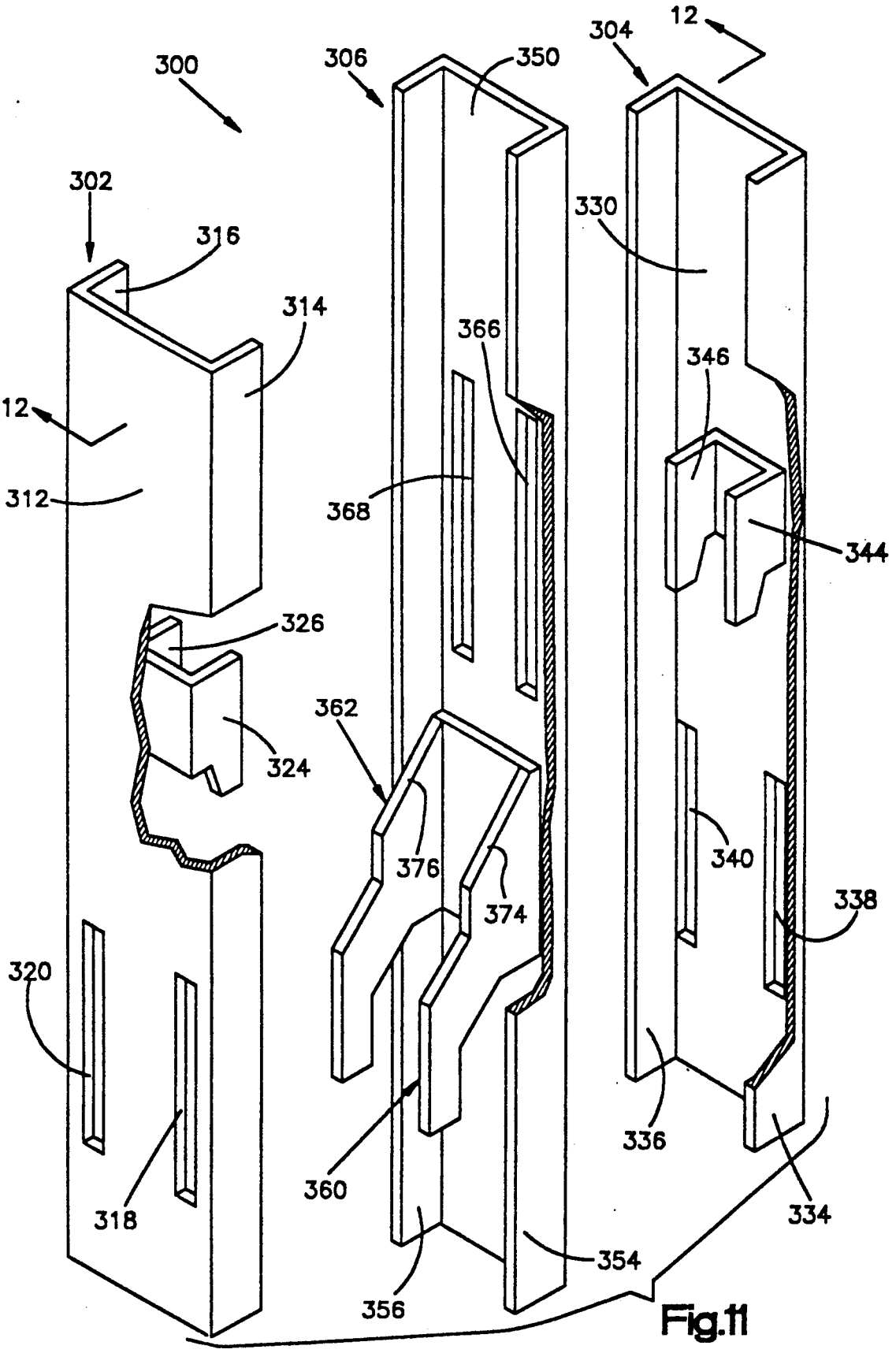
FIG. 11 is a partially broken away illustration of an improved joint assembly and depicting the relationship between a pair of vertical support members and a connector member before the support members have been moved together to enable them to be interconnected by the connector member, the support members being shown separate from their associated panel modules for purposes of clarity of illustration.

The right vertical support member 304 has the same construction as the left vertical support member 302. Thus, the right vertical support member 304 includes a vertical web section 330 (FIG. 11). Front and rear flange sections 334 and 336 extend outwardly from and are perpendicular to the web section 330. The parallel flange sections 334 and 336 and web section 330 extend for the full length of the metal support member 304.

A plurality of vertically extending slots 338 and 340 are formed in the web section 330. Although only a pair of slots 338 and 340 have been shown in FIG. 11, it should be understood that there are a plurality of pairs of slots 338 and 340 throughout the length of the web section 330.

A plurality of hooks 344 and 346 (FIGS. 11 and 12) are connected to the inner side surface of the web section 330. The hooks 344 and 346 have the same configuration as the hooks 324 and 326 on the left support member 302. Although only a pair of hooks 344 and 346 have been shown in FIG. 11, it should be understood that there are a plurality of pairs of hooks 344 and 346 along the length of the web 330. The hooks 344 and 346 are spaced from the flanges 334 and 336. Therefore, channels are formed between the outer side surfaces of the hooks 344 and 346 and the inner side surfaces of the flanges 334 and 336.

Figures 12, 15:
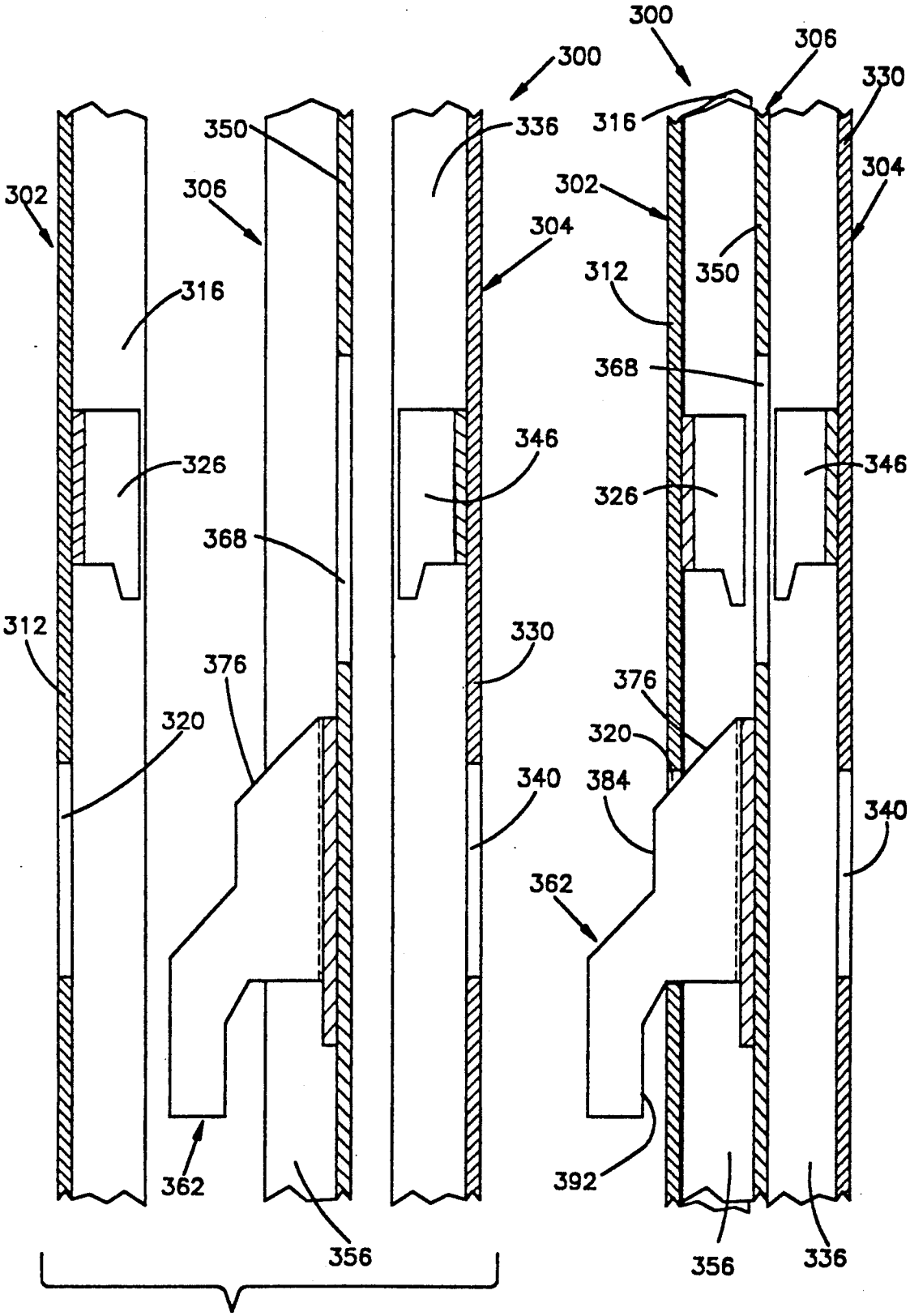
FIG. 12 is a sectional view, taken generally along the line 12—12 of FIG. 11, further illustrating the construction of the support members and the connector member.
FIG. 15 (on sheet 8 of the drawings) is a sectional view, taken generally along the line 15—15 of FIG. 14, further illustrating the relationship between the connector member and support members.

The left and right vertical support members 302 and 304 of adjacent unitary panel modules 22 are disposed at the same level relative to each other. Thus, the slots 320 and 318 in the left vertical support member 302 are vertically aligned with the slots 338 and 340 in the right vertical support member 304 (FIG. 12). Similarly, the hooks 324 and 326 on the left vertical support member 302 are vertically aligned with the hooks 344 and 346 on the right vertical support member 304.

The connector member 306 is initially placed in engagement with either the left or the right vertical support member 302 and 304 and is then moved sidewardly into engagement with the other vertical support member to interconnect the adjacent panel modules. The connector member 306 is sized so that it fits flush into the recess formed in either the support member 302 or 304. The metal connector member 306 (FIG. 11) includes a web section 350. A pair of parallel flanges 354 and 356 extend outwardly from the web 350. The flanges 354 and 356 extend throughout the length of the connector member 306.

A plurality of hooks 360 and 362 extend outwardly from the web section 350 past the outer edges of the flanges 354 and 356. The hooks 360 and 362 are disposed immediately adjacent to the flanges 354 and 356. Therefore, there is very little or no space between the side surfaces of the hooks 360 and 362 and the inner side surfaces of the flanges 354 and 356. Although only a pair of hooks 360 and 362 have been shown in FIG. 11, it should be understood that there are a plurality of pairs of hooks 360 and 362 along the length of the web 350.

A pair of vertically extending slots 366 and 368 are formed in the web 350. The slots 366 and 368 have a length which is greater than the length of the slots 318, 320, 338 and 340 in the vertical support members 302 and 304. Although only a pair of slots 366 and 368 have been shown in FIG. 11, it should be understood that there are a plurality of pairs of slots 366 and 368 along the length of the web 350.

The connector member 306 can be positioned in initial engagement with either the support member 302 or the support member 304. Thus, the hooks 360 and 362 on the connector member 306 are engageable with either the slots 318 and 320 in the left vertical support member 302 or with the slots 338 and 340 in the right vertical support member 304. Similarly, the slots 366 and 368 (FIG. 11) in the connector member 306 are engageable with either the hooks 324 and 326 on the left vertical support member 302 or the hooks 344 and 346 on the right vertical support member 304. The hooks 360 and 362 on the connector member 306 are engageable with a pair of slots in one of the two vertical support members 302 or 304 and the slots 366 and 368 engage the hooks on the other vertical support member.

Figure 13:
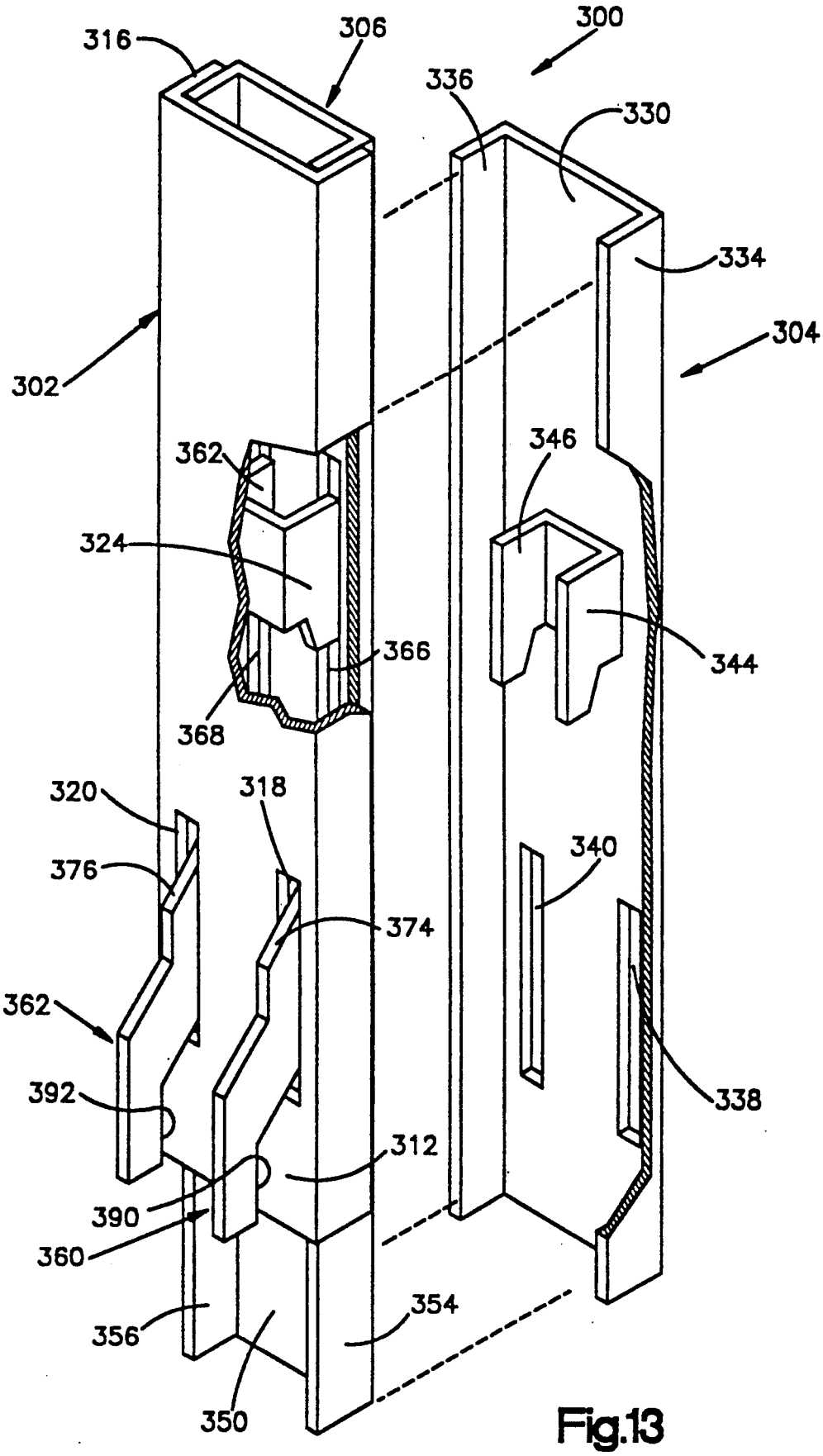
FIG. 13 is a partially broken away illustration, generally similar to FIG. 11, illustrating the relationship between the connector member and one of the support members when the connector member has been initially connected with the one support member.

Immediately before or after the left panel module is placed in an upright position extending between the ceiling and floor, the connector member hooks 360 and 362 are positioned in the slots 318 and 320 in the left vertical support member 302 (FIG. 13). At this time, the connector member 306 is received between the flanges 314 and 316 of the left vertical support member 302. The hooks 324 and 326 on the side of the left vertical support member 302 (FIG. 11) extend toward but not through the slots 366 and 368 in the web 350 of the connector member 306. At this time (FIG. 13), the weight of the connector member 306 is carried by the vertical support member 302.

Figure 14:
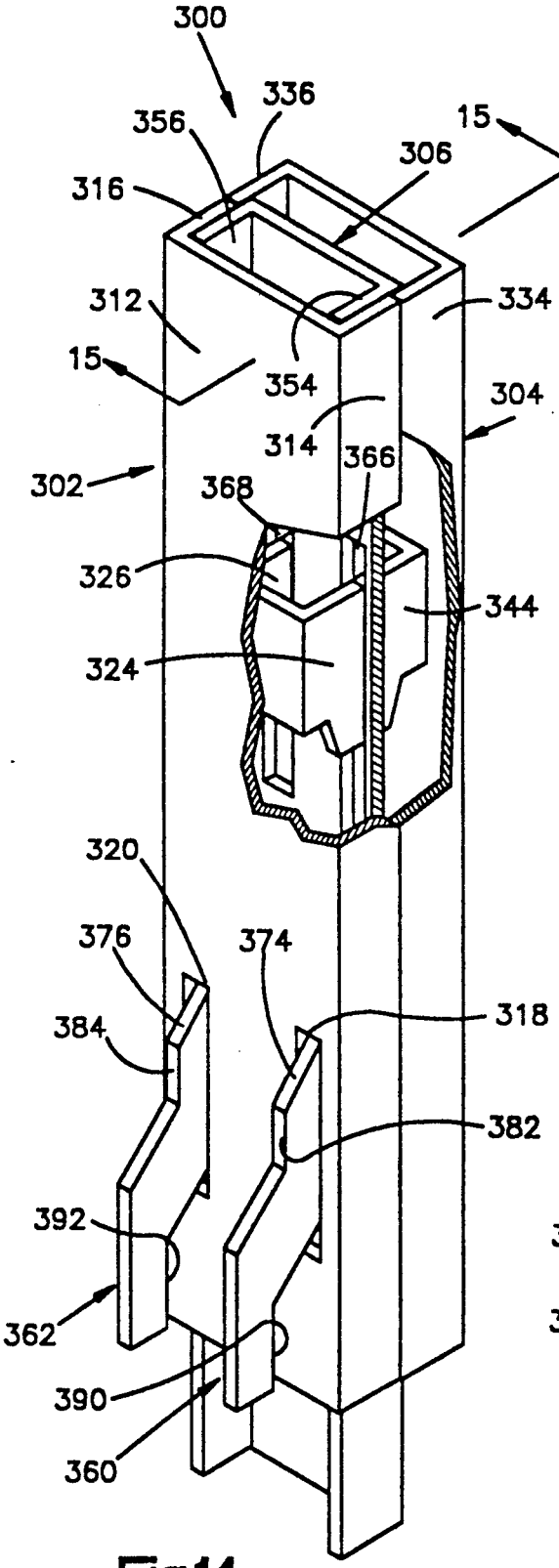
FIG. 14 is an illustration, generally similar to FIGS. 11 and 13, of the relationship between the two support members and the connector member when the support members have been positioned in engagement with each other by installing the adjacent panel modules.

The adjacent unitary panel module and the right vertical support member 304 are then positioned adjacent to the left vertical panel module unit and the left vertical support member 302 (FIGS. 14 and 15). The flanges 334 and 336 (FIG. 14) on the right vertical support member 304 abut the flanges 314 and 316 on the left vertical support member when the adjacent left and right panel modules are installed adjacent to each other. It should be noted that there is only one connector member 306 between the left and right vertical support members 302 and 304.

After the two adjacent panel module units have been positioned relative to each other (FIGS. 14 and 15), an upward force is applied to the lower end portion of the connector member 306. The upward force which is applied against the lower portion of the connector member 306 results in cam surfaces 374 and 376 (FIG. 14) moving vertically upwardly to upper end portions of the slots 318 and 320.

Figure 16:
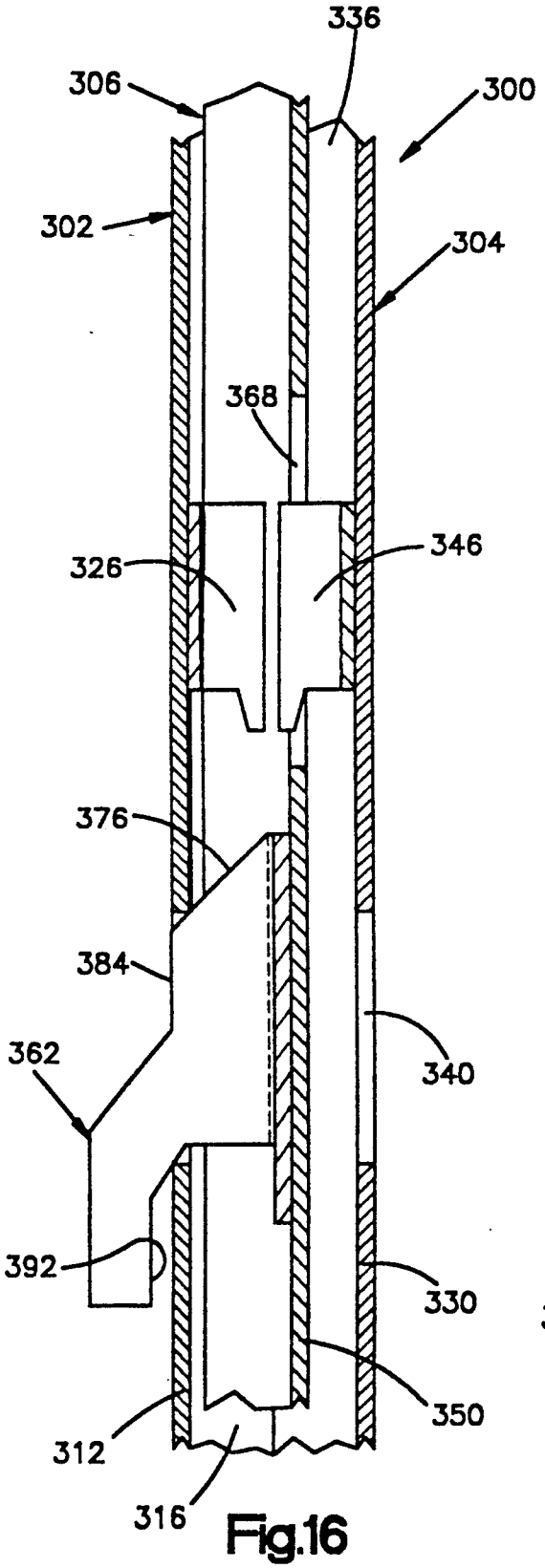
FIG. 16 (on sheet 11 of the drawings) is a sectional view, generally similar to FIG. 15, illustrating the manner in which the connector member moves upwardly and sidewardly to initiate interconnection of the two support members.

Continued upward movement of the connector member 306 relative to the vertical support members 302 and 304 causes the cam surfaces 374 and 376 (FIG. 14) on the hooks 360 and 362 to press against the upper edges of the slots 318 and 320. The upper edges of the slots engage the cam surfaces 374 and 376 on the hooks 360 and 362 to cam or force the connector member 306 sidewardly. This moves the connector member 306 away from the left vertical support member 302 toward the right vertical support member 304 (FIG. 16). As this upward and sideward movement of the connector member 306 continues, vertical side surfaces 382 and 384 on the hooks 360 and 362 move into abutting engagement with the inner side surface of the web 312 on the left support member 302 (FIGS. 17 and 18).

As the cam surfaces 374 and 376 on the hooks 360 and 362 (FIG. 14) engage the upper edges of the slots 318 and 320 and move the connector member 306 sidewardly, the slots 366 and 368 (FIG. 11) in the connector member move over the hooks 344 and 346 on the right support member 304. Thus, as the connector member 306 moves upwardly and sidewardly from the position shown in FIG. 15, the hooks 344 and 346 on the right support member extend through the slots 366 and 368, in the manner shown in FIG. 16.

When the vertical side surfaces 382 and 384 on the hooks 360 and 362 (FIG. 14) have moved into engagement with the inner side of the web 312 on the left vertical support member 302 (FIGS. 17 and 18) sideward movement of the connector member 306 under the influence of the cam surfaces 374 and 376 stops. At this time, the slots 366 and 368 (FIG. 11) in the connector member 306 will have moved across the hooks 344 and 346 on the inside of the right vertical support member 304 (FIGS. 17 and 18).

Figure 17:
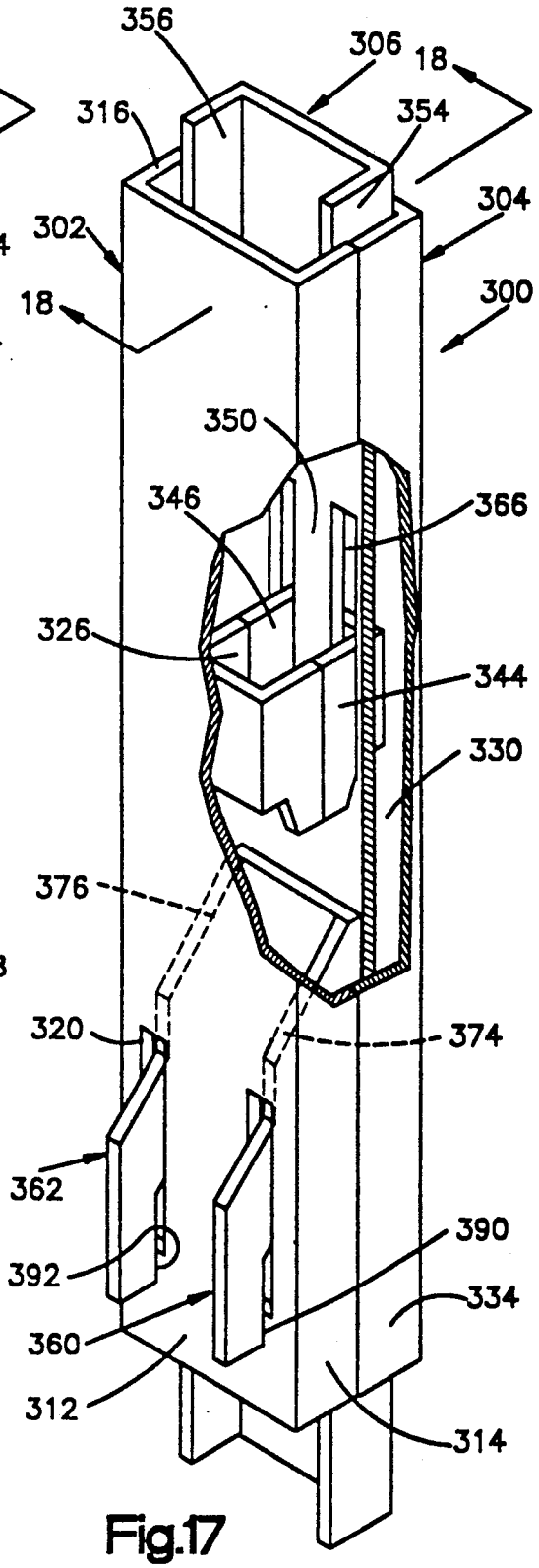
FIG. 17 (on sheet 10 of the drawings) is a partially broken away illustration, similar to FIG. 14, of the manner in which the adjacent support members are interconnected by the connector member.
Figure 18:
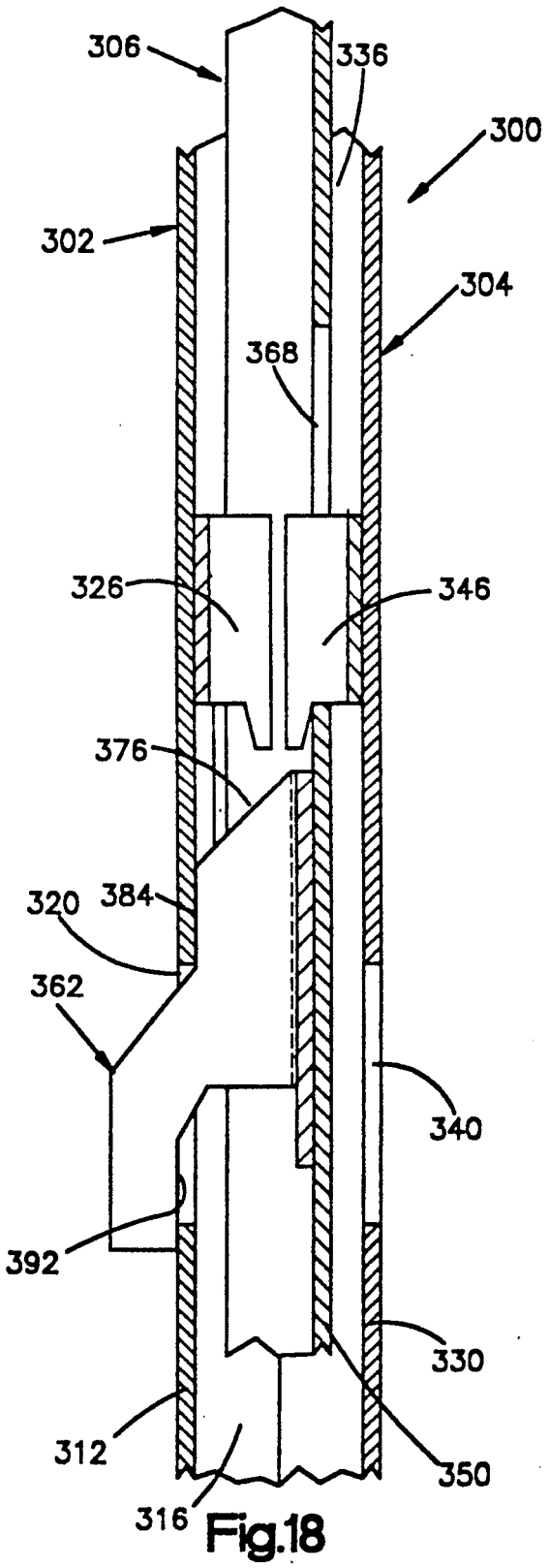
FIG. 18 (on sheet 11 of the drawings) is a sectional view, taken generally along the line 18—18 of FIG. 17, further illustrating the relationship between the interconnected support members and connector member.
Figure 19:
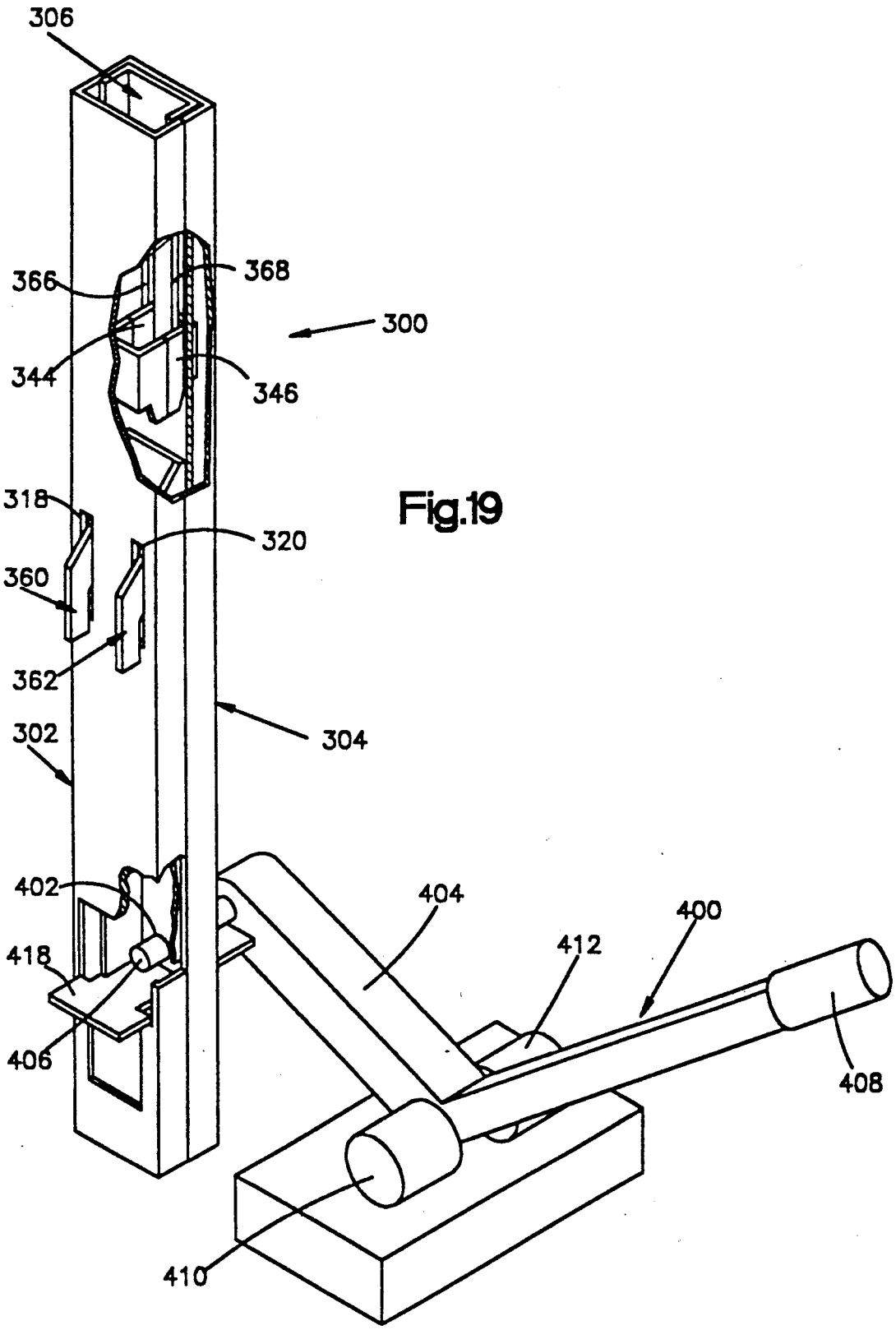
FIG. 19 is a partially broken away view schematically illustrating the manner in which force is applied to an actuator surface at the lower end portion of a connector member to move it upwardly relative to a pair of support members.

Continued straight upward movement of the connector member 306 moves the web 350 on the connector member beneath the hooks 344 and 346 on the right vertical support member 304 (FIGS. 17 and 18). Upward movement of the connector member 306 is blocked when the lower ends of the slots 366 and 368 in the connector member move into abutting engagement with the hooks 344 and 346, as shown in FIG. 18. This results in the connector member 306 being connected with the right vertical support member 304.

The connector member 306 is connected with the left vertical support member 302 by abutting engagement of vertical inner side surfaces 390 and 392 (FIGS. 14, 17 and 18) on the hooks 360 and 362 with the outer side surface of the web 312 on the left vertical support member 302. Thus, the connector member 306 is connected with the right vertical support member 304 by engagement slots 366 and 368 in the connector member with the hooks 344 and 346 on the left support member. The connector member 306 is connected with the left vertical support member 302 by engagement of the hooks 360 and 362 with the slots 318 and 320 in the left vertical support member 302. Therefore, the adjacent support members 302 and 304 and associated unitary panel modules are interconnected by the connector member 306.

To apply an upwardly directed force to the lower end portion of connector member 306, a jack 400 (FIG. 19) engages an actuator surface formed by a circular opening 402 on the lower end portion of the connector member 306. The opening 64 in the connector member 56 of FIGS. 3 and 4 corresponds to the opening 402 in the connector member 306 of FIGS. 11–19.

Since the adjacent panel units 22 have been installed in their desired positions adjacent to each other and since the opening 402 in the connector member 306 is disposed between the vertical support members 302 and 304, an arm 404 extends into the open lower portion of the base assembly 46 before the trim panels 266 and 268 are installed. An actuator pin 406 (FIG. 19) on the outer end of the arm 404 is inserted into the opening 402 in the connector member 306. Downward force is applied against the handle 408 of the jack 400. This causes the jack 400 to pivot on rollers 410 and 412. As the connector member 306 and actuator pin 406 on the jack arm 404 move straight upwardly, the rollers 410 and 412 move forward slightly toward the connector member 306.

As the jack 400 pivots and the actuator pin 406 moves upwardly, the connector member 306 is moved to its fully raised position interconnecting the vertical support members 302 and 304 (FIG. 18). A blocking or latch plate 418 is then inserted into slots formed in the vertical support members 302 and 304 immediately beneath the lower end of the connector member 306. This enables the plate 418 to block downward movement of the connector member 304 and hold the connector member in its engaged position.

When the adjacent panel modules are to be disconnected from each other, it is merely necessary to remove the trim panels 266 and 268 from the base assembly 46 and remove the blocking plate 418. The weight of the connector member 306 causes it to move downwardly and sidewardly back toward the left vertical support member 302. This disengages the connector member 306 from the right vertical support member 304. The unitary panel modules are then free to be moved relative to each other.

SUMMARY

In view of the foregoing description, it is apparent that the present invention provides a unitary panel module 22 which is used in constructing a partition. The panel module 22 (FIG. 2) is assembled at a factory or other location and shipped to the building 30 (FIG. 1) where it is to be installed. To install the pre-assembled panel module 22, the resiliently compressible upper end portion or head assembly 42 of the panel module is positioned in engagement with a ceiling structure 44 at a desired location (FIG. 5). An upward force is applied against the lower portion of the panel module 22 to resiliently compress the head assembly 42 against the ceiling structure and to lift the lower end portion or base 46 of the panel module from the floor 48. The base 46 of the panel module can then be positioned in a desired location relative to the floor 48 without dragging the panel module across the floor.

Each panel module 22 is a unitary structure which includes a pair of parallel main panel members 36 and 38 (FIG. 6) which are connected with a main frame 72. An adjustable base assembly 46 (FIGS. 9 and 10) is disposed at the lower end portions of the main frame 72 and panel members 36 and 38. An adjustable head assembly 42 (FIGS. 7 and 8) is disposed at the upper end portions of the main frame 72 and panel members 36 and 38.

An improved connector assembly 300 (FIG. 11) is used to interconnect adjacent panel modules 22. The improved connector assembly 300 includes an elongated connector member 306 which is positioned in a recess (FIG. 13) in a vertical edge portion of one of the panel modules. The connector member 306 is moved upwardly and sidewardly to interconnect the one panel module with an adjacent panel module.

Having described specific preferred embodiments of the invention, the following is claimed:

1. A panel assembly for use in constructing a partition, said panel assembly comprising a main frame, a pair of parallel main panel members fixedly connected to opposite sides of said main frame, said main frame including a rectangular array of wall sections having major side surfaces extending perpendicular to and disposed between said main panel members, a first rectangular array of flange sections disposed between said main panel members and connected with and extending outwardly from a first edge portion of said rectangular array of wall sections, each flange section of said first rectangular array of flange sections having an outer major side which is engaged by a first one of said main panel members, means for connecting said first main panel member to said first rectangular array of flange sections, a second rectangular array of flange sections disposed between said main panel members and connected with and extending outwardly from a second edge portion of said rectangular array of wall sections, each flange section of said second rectangular array of flange sections having an outer major side which is engaged by a second one of said main panel members, and means for connecting said second main panel member to said second rectangular array of flange sections, said rectangular array of wall sections and said first and second rectangular arrays of flange sections corresponding to at least partially define a rectangular recess which is disposed between said main panel members and opens outwardly from said rectangular array of wall sections toward edge portions of said main panel members and is co-extensive with perimeters of said main panel members, a vertically adjustable base assembly disposed adjacent lower end portions of said main frame and main panel members, an upper end portion of said base assembly being disposed between said main panel members in the rectangular recess between said first and second rectangular arrays of flange sections, a vertically adjustable head assembly disposed adjacent upper end portions of said main frame and main panel members, a lower end portion of said head assembly being disposed between said main panel members in the rectangular recess between said first and second rectangular arrays of flange sections, a first vertical support member connected with said base assembly and extending upwardly from said base assembly along a first side of said main frame to said head assembly, said first vertical support member being disposed between said main panel members in the rectangular recess between said first and second rectangular arrays of flange sections, and a second vertical support member connected with said base assembly and extending upwardly from said base assembly along said main frame to said head assembly, said second vertical support member being disposed between said main panel members in the rectangular recess between said first and second rectangular arrays of flange sections, said first and second vertical support members each including means disposed between said main panel members in the rectangular recess between said first and second rectangular arrays of flange sections for use in connecting said panel assembly with an adjacent element of the partition.

2. A panel assembly as set forth in claim 1 further including an elongated connector member, a plurality of hook elements projecting from a first side of said connector member, said means disposed between said main panel members for use in connecting said panel assembly with an adjacent element of the partition including slots in said first support member for receiving said hook elements, actuator surface means on said connector member for receiving force to move said connector member axially along said first support member, cam surface means on said hook elements for applying force against said first support member to move said connector member transversely away from said first support element from a first position in which said connector member is disposed within the rectangular recess to a second position in which said connector member is at least partially disposed outside of the rectangular recess as said connector member is moved axially along said first support member by force applied to said actuator surface means.

3. A panel assembly as set forth in claim 1 wherein said upper end portion of said base assembly includes a panel support member having a flat web section with an upper side surface which is disposed adjacent to and extends across space between lower ends of said main panel members, a first flange which is formed as one-piece with said web section and extends upwardly from the upper side surface of said web section at a first edge of said web section, said first flange having an inner side surface disposed in an overlapping relationship with an outer side surface of a first main panel member of said pair of main panel members, a second flange which is formed as one-piece with said web section and extends upwardly from the upper side surface of said web section, said second flange extending parallel to said first flange and having an inner side surface disposed in an overlapping relationship with an outer side surface of a second main panel member of said pair of main panel members, a first locating panel extending upwardly from the upper side surface of said web section and having an outer side surface which extends parallel to said first flange and extends along an inner side surface of said first main panel member, and a second locating panel extending upwardly from the upper side surface of said web section and having an outer side surface which extends parallel to said second flange and extends along an inner side surface of said second main panel member, said first and second locating panels being at least partially disposed between said main panel members in the rectangular recess between said first and second rectangular arrays of flange sections, said web section extending between lower end portions of said first and second locating panels.

4. A panel assembly as set forth in claim 3 wherein said upper end portion of said base assembly further includes a first mounting element which extends upwardly from the upper side surface of said web section at a location which is adjacent to a first end portion of said web section, a second mounting element which extends upwardly from the upper side surface of said web section at a location which is adjacent to a second end portion of said web section, said panel assembly further including first connector means for connecting said first support member with said first mounting element and second connector means for connecting said second support member with said second mounting element.

5. A panel assembly as set forth in claim 1 wherein said head assembly includes a base member having a web section disposed between said main panel members in the rectangular recess between said first and second rectangular arrays of flange sections, a first panel section which extends upwardly from an upper side surface of said web section, said first panel section having an outer side surface which extends along an inner side surface of a first main panel member, a second panel section which extends upwardly from the upper side surface of said web section and extends parallel to said first panel section, said second panel section having an outer side surface which extends along an inner side surface of said second main panel member.

6. A panel assembly as set forth in claim 5 wherein said head assembly further includes an extension member movable toward and away from said base member to vary the vertical extent of said head assembly, said extension member including an upper end portion, a first side panel extending downwardly from said upper end portion and having a side surface which is slidable along a side surface of said first panel section, and a second side panel extending downwardly from said upper end portion and extending parallel to said first side panel, said second side panel having a side surface which is slidable along a side surface of said second panel section, said first and second side panels of said extension member being slidable along said first and second panel sections of said base member.

7. A panel assembly as set forth in claim 1 wherein said first vertical support member includes a web section which is disposed in the rectangular recess adjacent to said rectangular array of wall sections of said main frame, said web section of said first vertical support member extending perpendicular to said main panel members, a first flange section extending outwardly from said web section of said first vertical support member and disposed in the rectangular recess adjacent to a flange section of the first rectangular array of flange sections of said main frame, a second flange section extending outwardly from said web section of said first vertical support member and disposed in the rectangular recess adjacent to a flange section of the second rectangular array of flange sections of said main frame, said second vertical support member includes a web section which is disposed in the rectangular recess adjacent to said rectangular array of wall sections of said main frame on a side of said rectangular array of wall sections opposite from said first vertical support member, said web section of said second vertical support member extending perpendicular to said main panel members, a first flange section extending outwardly from said web section of said second vertical support member and disposed in the rectangular recess adjacent to a flange section of the first rectangular array of flange sections of said main frame, a second flange section extending outwardly from said web section of said second vertical support member and disposed in the rectangular recess adjacent to a flange section of the second rectangular array of flange sections of said main frame.

8. A panel assembly as set forth in claim 1 wherein said head assembly includes a base member which is at least partially disposed between said main panel members in the rectangular recess between said first and second rectangular arrays of flange sections, an extension member which is movable toward and away from said base member to vary the vertical extent of said head assembly, and a plurality of leaf springs disposed between said base member and said extension member for urging said extension member upwardly from said base member.

9. A panel assembly as set forth in claim 8 wherein each of said leaf springs includes a lower portion which engages said base member at a location disposed between said main panel members in the rectangular recess between said first and second rectangular arrays of flange sections and an upper portion which engages said extension member at a location disposed outside of the rectangular recess and above said main panel members.

10. A panel assembly as set forth in claim 8 wherein each of said leaf springs has an end portion which is disposed in abutting engagement with one of said base and extension members, said end portion of each of said leaf springs being slidable along a surface of said one of said base and extension members upon movement of said extension member relative to said base member to vary the vertical extent of said head assembly.

11. A panel assembly as set forth in claim 1 wherein said first vertical support member includes a web section which is disposed in the rectangular recess and extends perpendicular to said main panel members, a first flange section extending outwardly from said web section of said first vertical support member and disposed in the rectangular recess, and a second flange section extending outwardly from said web section of said first vertical support member and disposed in the rectangular recess, said panel assembly further including an elongated connector member at least partially disposed in the rectangular recess between said first and second flange sections of said first vertical support member and disposed in engagement with said means for use in connecting said panel assembly with an adjacent element of the partition.

12. An assembly comprising a first panel assembly, said first panel assembly including a first pair of main panel members and a first longitudinally extending support member connected with and disposed between said first pair of main panel members, said first support member including a longitudinally extending web section having a vertical major side surface extending perpendicular to and disposed between said main panel members, a first longitudinally extending flange section disposed between said main panel members and connected with and extending outwardly from a first edge portion of said web section toward an edge portion of a first panel member of said first pair of main panel members, and a second longitudinally extending flange section disposed between said panel members and connected with and extending outwardly from a second edge portion of said web section toward an edge portion of a second panel member of said first pair of main panel members, said first and second flange sections cooperating with said web section to at least partially define a longitudinally extending recess in said first support member, said first support member including surface means connected with said web section for defining a plurality of longitudinally extending openings having longitudinal axes extending parallel to longitudinal axes of said first and second flange sections, a second panel assembly disposed adjacent to said first panel assembly, said second panel assembly including a second pair of main panel members and a second vertical support member connected with and disposed between said second pair of panel members, said second support member including a longitudinally extending web section having a vertical major side surface extending perpendicular to and disposed between said main panel members of said second pair of main panel members, a first longitudinally extending flange section disposed between said main panel members of said second pair of main panel members and connected with and extending outwardly from a first edge portion of said web section of said second support member toward an edge portion of a first panel member of said second pair of main panel members, and a second longitudinally extending flange section disposed between said panel members of said second pair of main panel members and connected with and extending outwardly from a second edge portion of said web section of said second support member toward an edge portion of a second panel member of said second pair of main panel members, said first and second flange sections of said second support member cooperating with said web section of said second support member to at least partially define a longitudinally extending recess in said second support member, said second support member including a plurality of retaining surfaces connected with said web sections of said second support member, and connector means for interconnecting said first and second panel assemblies, said connector means including an elongated movable connector member having a plurality of hook elements each of which extends into one of the openings in said first support member, said connector member being movable upwardly and sidewardly relative to said first and second support members from a release position in which said connector member is supported in the recess in said first support member by engagement of said hook elements with said first support member to an engaged position in which said hook elements on said connector member extend into the openings in said first support member and which connector surface means on said connector member engages said retaining surfaces on said second support member, said first and second support members being interconnected by said connector member when said connector member is in the engaged position by engagement of said hook elements with said first support member and by engagement of said connector surface means with said retaining surfaces on said second support member, said connector member having actuator surface means for receiving an upwardly directed force to move said connector member upwardly from the release position toward the engaged position, said connector member having cam surface means for transmitting force between said connector member and said first support member to move said connector member sidewardly out of the recess in said first support member into the recess in said second support member as said connector member moves upwardly under the influence of force applied against said actuator surface means, said first flange section of said first support member being disposed in abutting engagement with said first flange section of said second support member when said connector member is in the engaged position, said second flange section of said first support member being disposed in abutting engagement with said second flange section of said second support member when said connector member is in the engaged position.

13. An assembly as set forth in claim 12 wherein said cam surface means is disposed on said hook elements and cooperate with said surface means which defines a plurality of openings in said first support member to cam said connector member sidewardly toward said second support member as said connector member moves upwardly.

14. An assembly as set forth in claim 12 wherein said plurality of retaining surfaces are disposed on a second plurality of hook elements connected with said second support member, said connector surface means on said connector member including surface means for defining a second plurality of openings in which said second plurality of hook elements are received during upward and sideward movement of said connector member.

15. An assembly as set forth in claim 12 further including blocking means disposed beneath said connector member for blocking downward movement of said connector member when said connector member is in the engaged position.

16. An assembly as set forth in claim 12 wherein said first panel assembly includes a first rectangular main frame disposed between and connected with said first pair of main panels, said second panel assembly including a second rectangular main frame disposed between and connected with said second pair of main panels.

17. An assembly as set forth in claim 12 wherein said first panel assembly includes a first vertically adjustable base assembly disposed at lower end portions of said first pair of main panel members, an upper end portion of said first base assembly being disposed between said first pair of main panel members, and a first vertically adjustable head assembly disposed at upper end portions of said first pair of main panel members, a lower end portion of said first head assembly being disposed between said first pair of main panel members, said second panel assembly including a second vertically adjustable base assembly disposed at lower end portions of said second pair of main panel members, an upper end portion of said second base assembly being disposed between said second pair of main panel members, and a second vertically adjustable head assembly disposed at upper end portions of said second pair of main panel members, a lower end portion of said second head assembly being disposed between said second pair of main panel members.

* * * * *

UNITED STATES PATENT AND TRADEMARK OFFICE

CERTIFICATE OF CORRECTION

PATENT NO. : 5,038,534

DATED : August 13, 1991

INVENTOR(S) : Gordon J. Pollock

It is certified that error appears in the above-identified patent and that said Letters Patent is hereby corrected as shown below:

Column 17, Lines 33 and 34, Claim 1, change "corresponding" to --cooperating--.

Column 21, Line 21, Claim 12, change "sections" to --section--.

Signed and Sealed this

Fifteenth Day of December, 1992

*Attest:*

DOUGLAS B. COMER

*Attesting Officer*

*Acting Commissioner of Patents and Trademarks*